US011021822B2

(12) United States Patent
Kawaguchi et al.

(10) Patent No.: US 11,021,822 B2
(45) Date of Patent: Jun. 1, 2021

(54) EMBROIDERY FRAME

(71) Applicant: BROTHER KOGYO KABUSHIKI KAISHA, Nagoya (JP)

(72) Inventors: Yasuhiko Kawaguchi, Nagoya (JP); Takahira Osamura, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 168 days.

(21) Appl. No.: 16/512,448

(22) Filed: Jul. 16, 2019

(65) Prior Publication Data

US 2019/0338450 A1 Nov. 7, 2019

Related U.S. Application Data

(63) Continuation of application No. PCT/JP2017/032443, filed on Sep. 8, 2017.

(30) Foreign Application Priority Data

Jan. 31, 2017 (JP) ..... JP2017-015206

(51) Int. Cl.
*D05C 1/02* (2006.01)
*D05C 9/04* (2006.01)
*D05B 39/00* (2006.01)

(52) U.S. Cl.
CPC ..... *D05C 1/02* (2013.01); *D05B 39/00* (2013.01); *D05C 9/04* (2013.01)

(58) Field of Classification Search
CPC ... D05C 1/02; D05C 1/00; D05C 1/04; D05C 9/04; D05C 9/00; D05C 9/10; D05C 9/12;

(Continued)

(56) References Cited

U.S. PATENT DOCUMENTS 5,353,725 A * 10/1994 Sakakibara ..... D05C 9/04 112/103
7,168,378 B2 * 1/2007 Fukao ..... D05B 39/00 112/103

(Continued)

FOREIGN PATENT DOCUMENTS

CH 349872 A * 10/1960
JP H11-061627 A 3/1999

(Continued)

OTHER PUBLICATIONS

Dec. 5, 2017 International Search Report issued in International Patent Application No. PCT/JP2017/032443.

*Primary Examiner* — Ismael Izaguirre
(74) *Attorney, Agent, or Firm* — Oliff PLC

(57) ABSTRACT

An embroidery frame includes a mounting portion, a first frame with a magnet, and a second frame with a main body portion and a guide portion. The mounting portion is configured to be removably mounted on a sewing machine. The main body portion includes a clamping surface. The guide portion is configured by a non-magnetic material, is provided on the clamping surface, includes an inclined surface, protrudes further than the clamping surface in a first direction intersecting the clamping surface, and guides the first frame to the clamping surface. The inclined surface is inclined in a direction opposite to the first direction the further the inclined surface extends in a second direction that is orthogonal to the first direction and is from an outer side toward an inner side of the second frame. The second frame can clamp easily a sewing object, with the first frame, using magnetic force.

12 Claims, 11 Drawing Sheets

(58) Field of Classification Search
CPC ..... D05B 39/00; D05B 31/00; D05B 33/00; D06C 3/08
See application file for complete search history.

(56) References Cited

U.S. PATENT DOCUMENTS

| | | | | |
|---|---|---|---|---|
| 7,918,169 | B2 * | 4/2011 | Mack | D05C 9/04 112/103 |
| 7,966,957 | B2 * | 6/2011 | Mack | D05C 9/04 112/103 |
| 9,340,913 | B1 * | 5/2016 | Gala | D05C 9/04 |
| 9,546,441 | B1 * | 1/2017 | Chen | D05C 1/06 |
| 2003/0074815 | A1 * | 4/2003 | Tajima | D05C 9/04 38/102.2 |

FOREIGN PATENT DOCUMENTS

| | | | | |
|---|---|---|---|---|
| JP | 2000-308779 | A | | 11/2000 |
| JP | 2002078996 | A | * | 3/2002 |
| JP | 2005-146460 | A | | 6/2005 |
| JP | 2010-082017 | A | | 4/2010 |
| JP | 3205701 | U | | 8/2016 |

* cited by examiner

EMBROIDERY FRAME

CROSS-REFERENCE TO RELATED APPLICATION

This application is a Continuation Application of International Application No. PCT/JP2017/032443, filed Sep. 8, 2017, which claims priority from Japanese Patent Application No. 2017-015206, filed on Jan. 31, 2017. This disclosure of the foregoing application is hereby incorporated by reference in its entirety.

BACKGROUND

The present disclosure relates to an embroidery frame that can be mounted on an embroidery sewing machine.

An embroidery frame that can be mounted on an embroidery sewing machine is known. The known embroidery frame is provided with magnets surrounding window portions of an upper frame and a lower frame. The known embroidery frame holds a sewing object using the magnetic force generated between the magnet of the upper frame and the magnet of the lower frame.

SUMMARY

It is necessary to cause the embroidery frame to clamp the sewing object while aligning positions of the window portion of the upper frame and the window portion of the lower frame. With the known embroidery frame, an operation to cause the clamping of the sewing object by aligning the relative positions of the upper frame and the lower frame is complex.

It is an object of the present disclosure to provide an embroidery frame in which an operation to cause a sewing object to be clamped appropriately between a first frame and a second frame, using a magnetic force acting between the first frame and the second frame, is easily performed.

Various embodiments herein provide a embroidery frame that includes a mounting portion, a first frame, and a second frame. The mounting portion is configured to be removably mounted on a sewing machine. The first frame is provided with a magnet. The second frame is configured to clamp a sewing object, with the first frame, using magnetic force. The second frame includes a main body portion and a guide portion. The main body portion includes a clamping surface configured by a magnetic material, in a position facing the magnet of the first frame. The guide portion is provided on an outer peripheral portion of the clamping surface and guiding the first frame to the clamping surface. The guide portion is configured by a non-magnetic material. The guide portion includes an inclined surface. The guide portion protrudes further than the clamping surface in a first direction with respect to the clamping surface. The first direction is, of directions that intersect the clamping surface, a direction to the side of the first frame with respect to the clamping surface. The inclined surface is inclined in a direction opposite to the first direction the further the inclined surface extends in a second direction. The second direction is a direction orthogonal to the first direction and is a direction from an outer side toward an inner side of the second frame.

BRIEF DESCRIPTION OF THE DRAWINGS

Embodiments of the disclosure will be described below in detail with reference to the accompanying drawings in which.

DETAILED DESCRIPTION OF EMBODIMENTS

Hereinafter, a first embodiment and a second embodiment of the present disclosure will be explained with reference to the drawings. A physical configuration of a multi-needle sewing machine (hereinafter simply referred to as a sewing machine) 1 and an embroidery frame 5 will be explained with reference to FIG. 1 and FIG. 2. In the following explanation, the upper side, the lower side, the lower left side, the upper right side, the upper left side, and the lower right side of FIG. 1 respectively denote the upper side, the lower side, the front side, the rear side, the left side and the right side of the sewing machine 1 and the embroidery frame 5.

Figure 1:
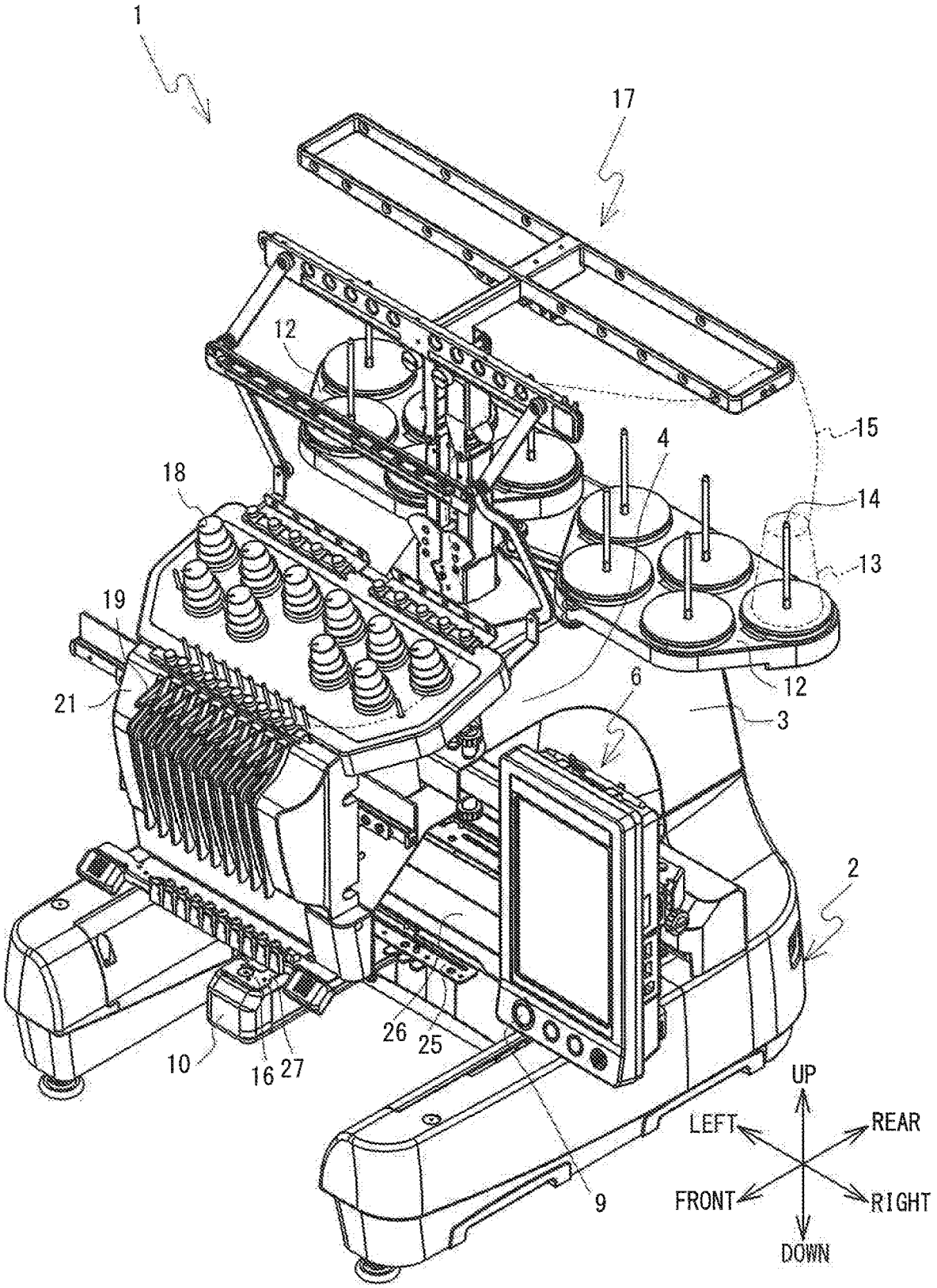
FIG. 1 is a perspective view of a sewing machine 1.

As shown in FIG. 1, the sewing machine 1 is provided with a support portion 2, a pillar 3, and an arm portion 4. The support portion 2 supports the sewing machine 1 as a whole. The pillar 3 extends upward from the rear end portion of the support portion 2. The arm portion 4 extends to the front from the upper end portion of the pillar 3. A needle bar case 21 is mounted on the leading end of the arm portion 4 such that the needle bar case 21 can move in the left-right direction. Ten needle bars (not shown in the drawings) that extend in the up-down direction are arranged inside the needle bar case 21 so as to be aligned at equal intervals in the left-right direction. Of the ten needle bars, one needle bar that is in a sewing position (a sewing needle bar) is caused to slide in the up-down direction by a needle bar drive mechanism (not shown in the drawings) that is driven by a main motor (not shown in the drawings) as a driving source thereof. A sewing needle (not shown in the drawings) can be mounted on the lower end of the needle bar. In concert with the up-and-down movement of the needle bar, a presser foot (not shown in the drawings) intermittently presses down a sewing object C (refer to FIG. 4B). The sewing object C is, for example, a sheet shape, such as a work cloth, leather, a resin sheet or the like.

Figure 2:
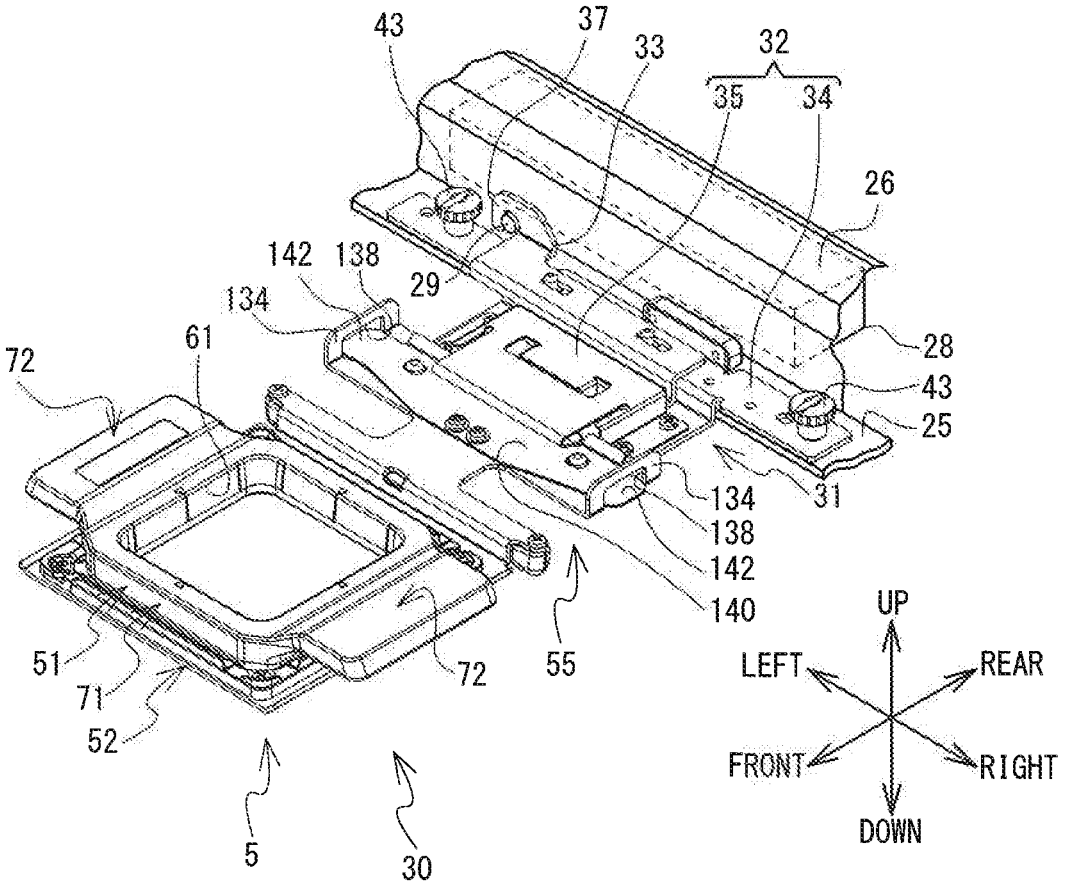
FIG. 2 is a perspective view of an embroidery frame unit 30.

As shown in FIG. 1, an operation portion 6 is provided on the arm portion 4. The operation portion 6 is provided with a start/stop switch 9. The start/stop switch 9 is used when commanding the start or the stop of sewing. A tubular cylinder bed 10 is provided below the arm portion 4, extending to the front from the lower end portion of the pillar 3. A shuttle (not shown in the drawings) is provided inside the leading end portion of the cylinder bed 10. The shuttle houses a bobbin (not shown in the drawings) on which is wound a lower thread (not shown in the drawings). A shuttle drive mechanism (not shown in the drawings) is accommodated inside the cylinder bed 10. The shuttle drive mechanism rotationally drives the shuttle. A needle plate 27 that is rectangular in a plan view is provided on the upper surface of the cylinder bed 10. A needle hole 16, through which the sewing needle is inserted, is provided in the needle plate 27. Of the ten needle bars, the needle bar positioned directly above the needle hole 16 is the sewing needle bar. A holder 25 of a movement mechanism (not shown in the drawings), a Y carriage 26, and an X carriage 28 are further provided below the arm portion 4. As shown in FIG. 2, the holder 25 of the movement mechanism supports the embroidery frame 5 via a frame attachment member 31. The movement mechanism can move the embroidery frame 5 mounted on the holder 25 to a position indicated by a unique XY coordinate system (an embroidery coordinate system). A pair of left and right thread spool bases 12 are provided to the rear side of the upper surface of the arm portion 4. A plurality of thread spool pins 14 are provided on each of the thread spool bases 12. The thread spool pins 14 support thread spools 13. Upper threads 15 are supplied from the thread spools 13 disposed on the thread spool base 12. The upper threads 15 are supplied to eyes (not shown in the drawings) of each of the sewing needles mounted on the lower ends of the needle bars, via a thread path. The thread path includes a thread guide 17, tensioners 18, and thread take-up levers 19.

An operation to form stitches in the sewing object C held by the embroidery frame 5 will be explained with reference to FIG. 1 and FIG. 2. The embroidery frame 5 that holds the sewing object C is supported by the holder 25 of the movement mechanism, via the frame attachment member 31. As a result of the needle bar case 21 moving to the left and the right, one of the ten needle bars is selected as the sewing needle bar. The embroidery frame 5 is moved to a predetermined position by the movement mechanism. In the needle bar drive mechanism and a thread take-up lever drive mechanism, the selected needle bar, and the thread take-up lever 19 corresponding to the selected needle bar are driven up and down by the main motor as the driving source. Further, the shuttle drive mechanism is driven by the rotation of the main motor and the shuttle is rotationally driven. As described above, the sewing needle, the thread take-up lever 19, and the shuttle are driven in synchronization with each other, and the stitches are formed on the sewing object C.

Figure 3:
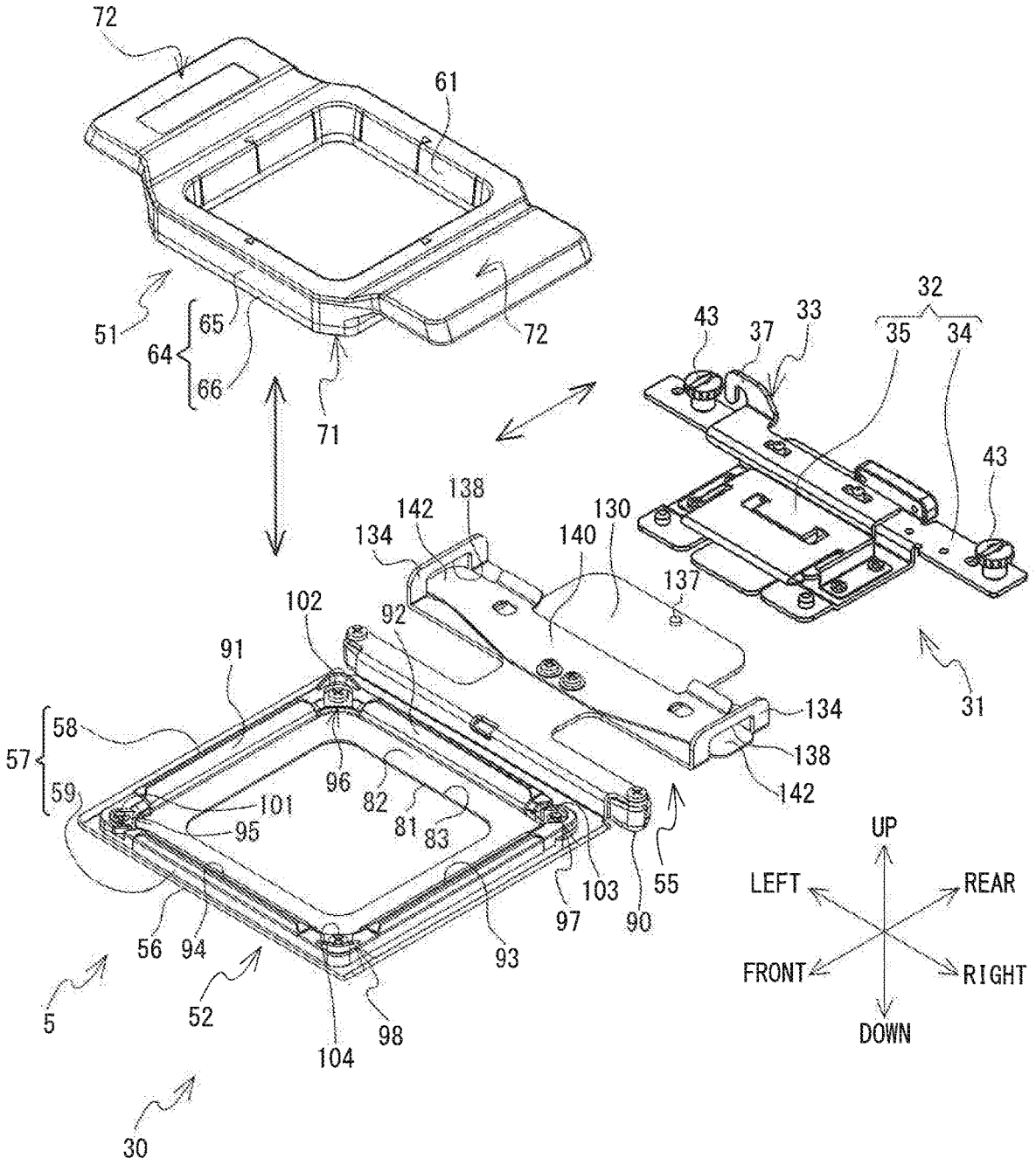
FIG. 3 is a perspective view of the embroidery frame unit 30 in a state in which an embroidery frame 5 is removed from a frame attachment member 31.

An embroidery frame unit 30 will be explained with reference to FIG. 2 to FIG. 9. The embroidery frame unit 30 can be removably mounted on the sewing machine 1. The embroidery frame unit 30 is provided with the embroidery frame 5 and the frame attachment member 31. The embroidery frame 5 includes a first frame 51, a second frame 52, and a mounting portion 55, and the sewing object C can be held between the first frame 51 and the second frame 52 using magnetic force. The frame attachment member 31 is removably mounted on the holder 25 of the sewing machine 1. The embroidery frame 5 is removably mounted on the frame attachment member 31. In other words, the embroidery frame 5 can be mounted on the sewing machine 1 of the present embodiment via the frame attachment member 31. The embroidery frame 5 of a present embodiment holds the sewing object C in the up-down direction using the first frame 51 and the second frame 52, in a state in which the embroidery frame 5 is mounted on the sewing machine 1. The first frame 51 is an upper frame and the second frame 52 is a lower frame. An inner edge 73 of the first frame 51 and an inner edge 83 of the second frame 52 are a polygonal shape. The first frame 51 and the second frame 52 are square frame shapes having rounded corners in a plan view. As shown in FIG. 2 and FIG. 3, the first frame 51 can be caused to approach or separate from the second frame 52.

Figure 4A:
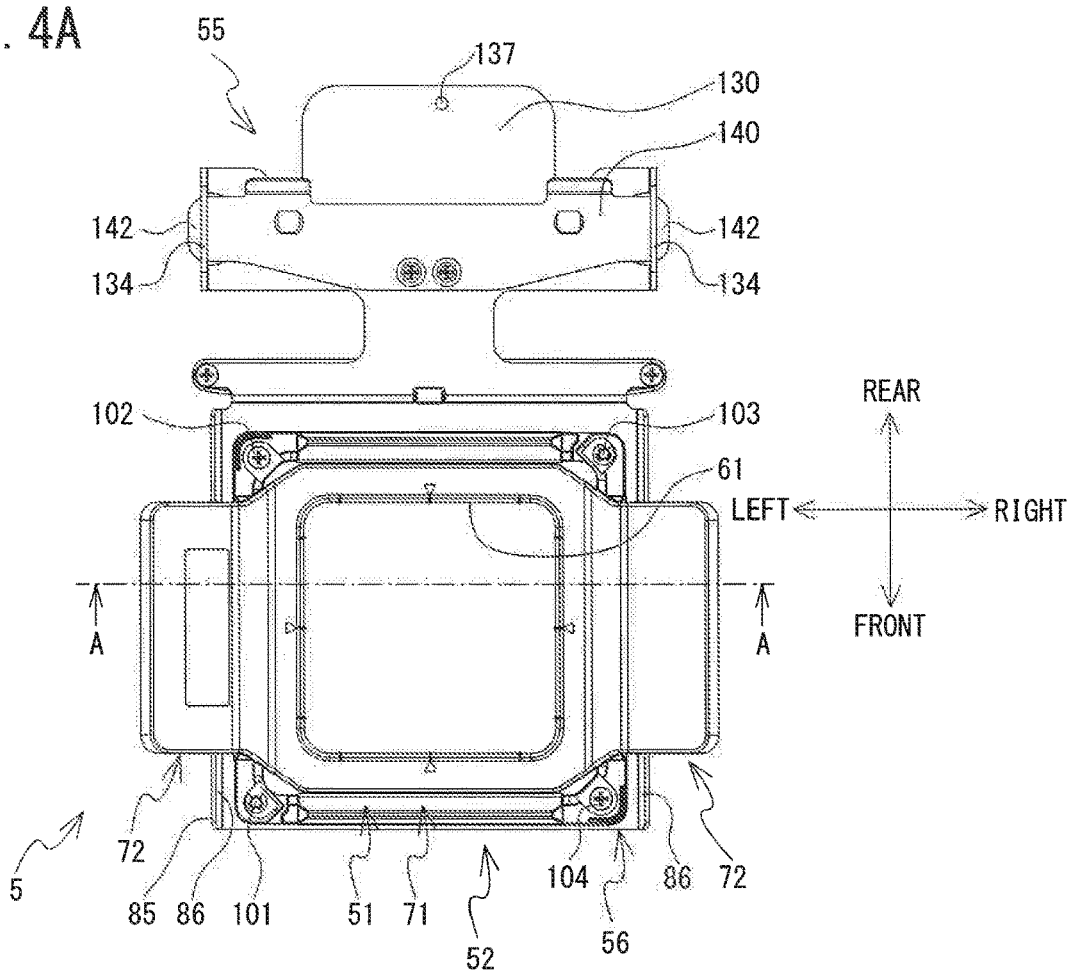
FIG. 4A is a plan view of the embroidery frame 5.
Figure 4B:
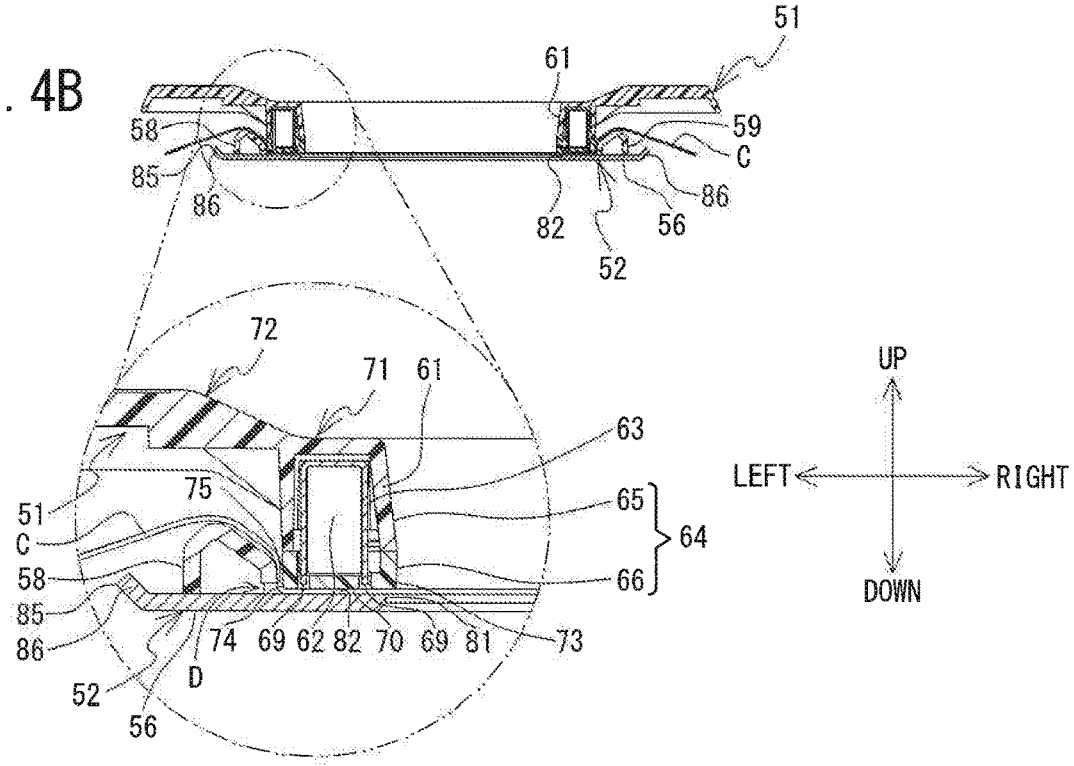
FIG. 4B is a cross-sectional view in the direction of arrows along a line A-A shown in FIG. 4A.
Figure 5:
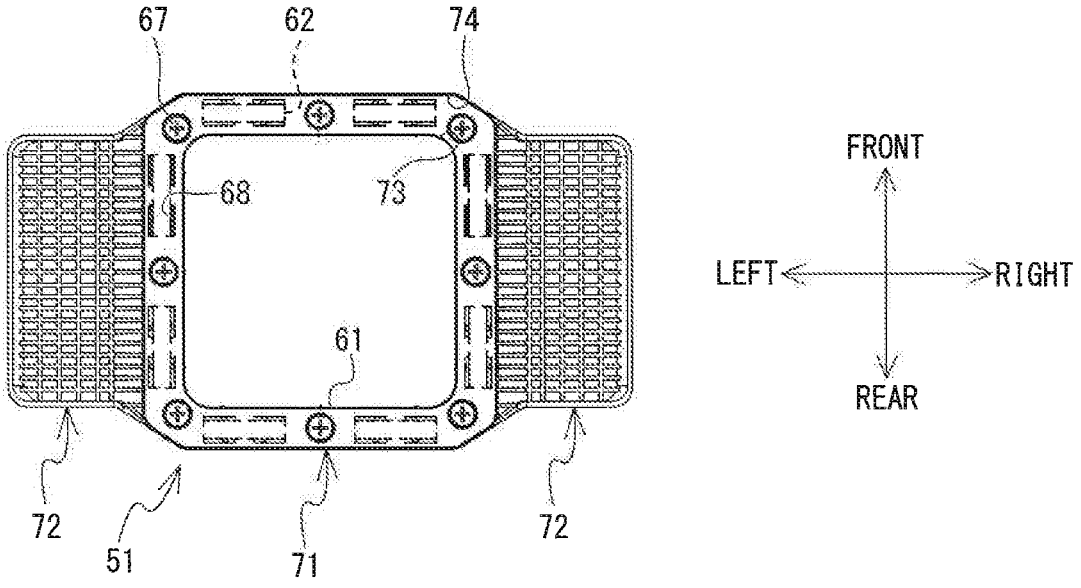
FIG. 5 is a bottom view of a first frame 51.

The first frame 51 is provided with a main body portion 71 and a pair of gripping portions 72. The main body portion 71 is a square shape having rounded corners, and is a frame shape having a hole 61 that penetrates in the thickness direction (the up-down direction). As shown in FIG. 4B and FIG. 5, the main body portion 71 of the first frame 51 is provided with magnets 62, yokes 63, and a cladding portion 64. The magnets 62 are arranged on a peripheral edge portion of the inner edge 73 of the first frame 51. The magnets 62 are rectangular-shaped, and a total of 8 of the magnets 62 are provided, two on each side, around the inner edge 73 of the first frame 51. The lengthwise direction of each of the magnets 62 is the same as an extending direction of the side of the first frame 51 on which the magnets 62 are arranged. Each of the yokes 63 conducts a magnetic flux caused by the magnet 62. As shown in FIG. 4B, the yoke 63 is a magnetic material (a steel plate, for example) having an inverted U shape that is open downward. The magnet 62 is disposed in a recessed portion of the yoke 63. An end portion 69 on the side of the second frame 52 (the lower side) of the yoke 63 is positioned to be lower than an end portion on the lower side of the magnet 62. As shown in FIG. 5, two of the yokes 63 are disposed with respect to one of the magnets 62.

As shown in FIG. 4B, the cladding portion 64 is configured by a non-magnetic material (resin, for example) that holds the magnets 62 and the yokes 63. The cladding portion 64 of the present embodiment includes a first portion 65 and a second portion 66, and holds the magnets 62 and the yokes 63 using the first portion 65 and the second portion 66. The first portion 65 and the second portion 66 are fixed to each other using eight screws 67 (refer to FIG. 5). Of the eight screws 67, four of the screws 67 are fixed in the vicinity of four corner portion of the square-shaped first frame 51, and the remaining four screws 67 are fixed in the vicinity of the centers of the four sides of the first frame 51. As shown in FIG. 5, the magnets 62 and the yokes 63 are disposed between two of the adjacent screws 67 in a bottom view. The first portion 65 is a portion that forms the upper side of the main body portion 71, and the pair of gripping portions 72 are coupled to each of left and right end portions of the upper surface thereof. The pair of gripping portions 72 are handles that are used when a user causes the first frame 51 and the second frame 52 to approach each other or be separated from each other. As shown in FIG. 4A, in a usage state in which the sewing object C can be held by the magnetic force when the first frame 51 is close to the second frame 52, the left end of the left-side gripping portion 72 is further to the left than the left end of the second frame 52. The right end of the right-side gripping portion 72 is further to the right than the right end of the second frame 52. As shown in FIG. 4A, in a plan view, a square-shaped outer edge 74 of the main body portion 71 of the first frame 51 is smaller than a square-shaped outer edge 85 of the second frame 52. Of the upper surface of the first frame 51 (the first portion 65), triangular-shaped markers for positioning are added in the vicinity of the center of each of the four sides of the square shape in a plan view.

The second portion 66 is a portion that forms the main body portion 71 on the side of the second frame 52 (the lower side), and is provided with a recessed portion whose cross-sectional shape is a U shape that is open upward. The second portion 66 has a plurality of holes 68 in the surface thereof on the side of the second frame 52. Each of the holes 68 penetrates in a first direction (the upward direction). The end portions 69 of the yokes 63 on the side facing the second frame 52 are caused to be inserted into each of the holes 68, and cause the yokes 63 to be exposed to the outside of the cladding portion 64. The end portions 69 of the yokes 63 on the side facing the second frame 52 are exposed from the cladding portion 64 via the holes 68 of the second portion 66, and the end portions 69 do not protrude further to the side of the second frame 52 than an end portion 70 of the cladding portion 64 on the side facing the second frame 52 (the lower surface). When the sewing object C is clamped by the first frame 51 and the second frame 52, the end portion 70 of the cladding portion 64 is in contact with the sewing object C, but the magnets 62 and the yokes 63 do not come into contact with the sewing object C.

Figure 6A:
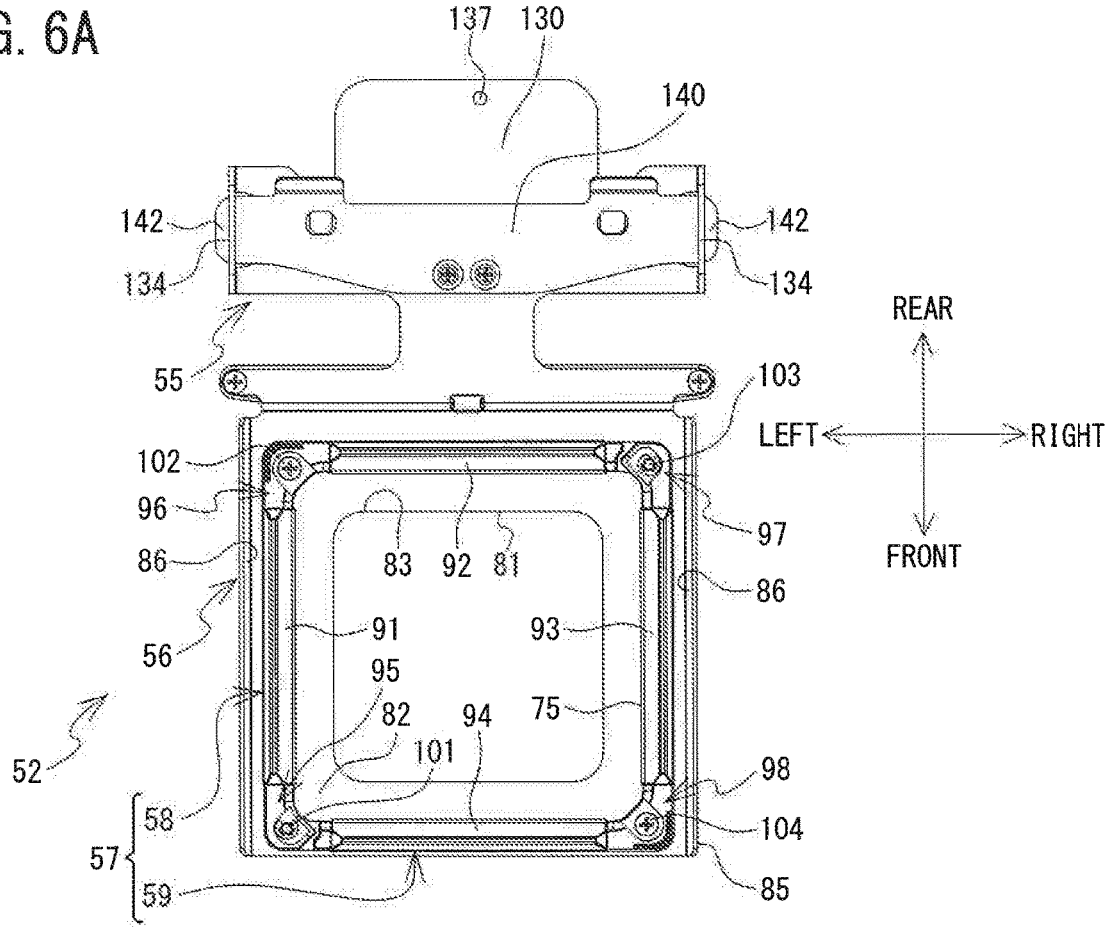
FIG. 6A is a plan view of a second frame 52 and a mounting portion 55.
Figure 6B:
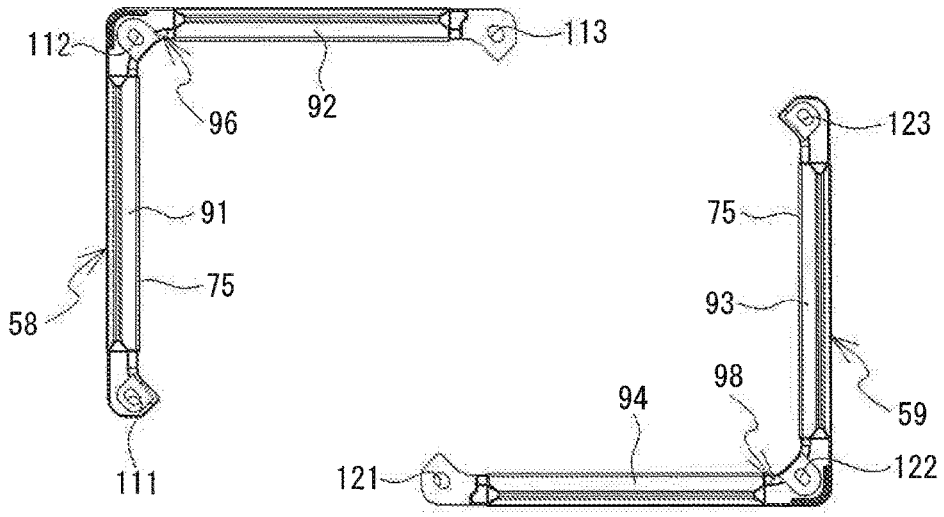
FIG. 6B is a plan view of moving members 58 and 59 of a guide portion 57.

The second frame 52 can clamp the sewing object C, together with the first frame 51, using the magnetic force. The second frame 52 has a main body portion 56 and a guide portion 57. As shown in FIG. 6A and FIG. 6B, the main body portion 56 is a square shape having rounded corners in a plan view, and is a frame shape having a hole 81 that penetrates in the up-down direction. The main body portion 56 has a clamping surface 82 that is configured by a magnetic material, in a position facing the magnets 62 of the first frame 51. The clamping surface 82 extends horizontally along a peripheral edge of the inner edge 83 of the main body portion 56. Of the upper surface of the main body portion 56, the clamping surface 82 is further to the side of the inner edge 83 than the guide portion 57. In the state in which the sewing object C is clamped by the first frame 51 and the second frame 52, the sewing object C is placed on the clamping surface 82. A pair of inclined portions 86, which incline in the first direction from the inner side toward the outer side of the second frame 52, are provided on a peripheral edge of the outer edge 85. The pair of inclined portions 86 of the present embodiment are provided on the end portions of the main body portion 56 in the left-right direction. The left-side inclined portion 86 is inclined in the first direction (the upward direction) diagonally to the left. The right-side inclined portion 86 is inclined in the upward direction diagonally to the right.

Figure 9A:
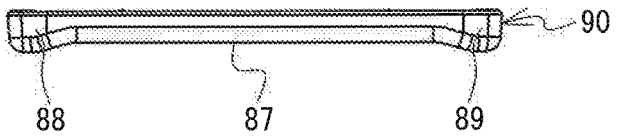
FIG. 9A is a front view of a protruding member 90.
Figure 9B:
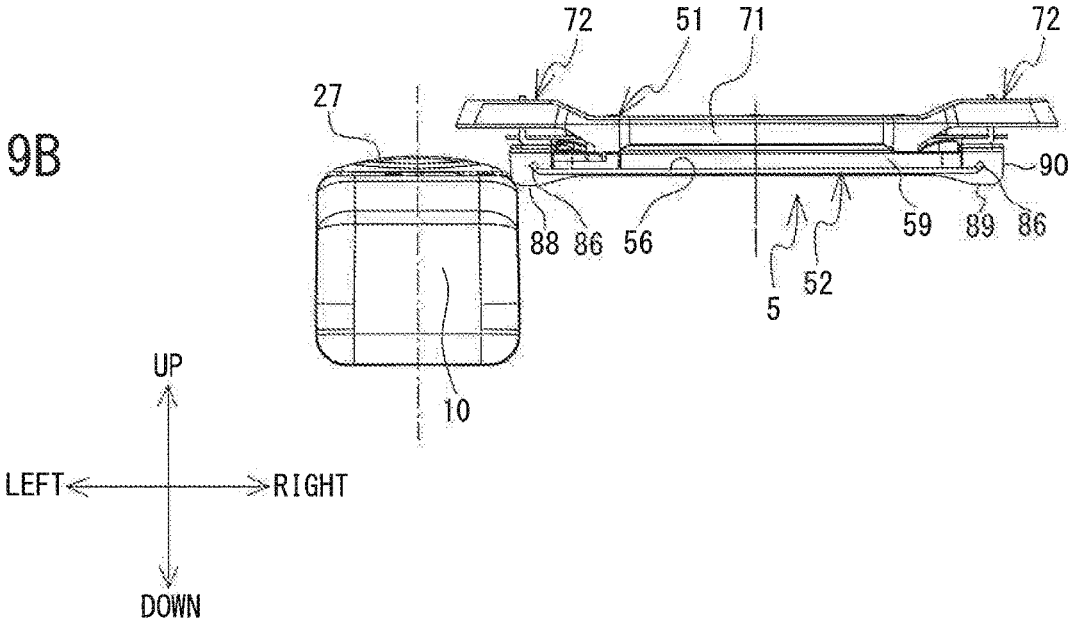
FIG. 9B is a front view when the second frame 52 of the embroidery frame 5 has moved further to the right than a cylinder bed 10.

The rear end portion of the main body portion 56 is coupled to the front end portion of an attachment member 130 of the mounting portion 55 to be described later. In the present embodiment, the main body portion 56 and the attachment member 130 are integrally configured from a magnetic material, such as stainless steel or the like. A protruding member 90, which extends in the left-right direction and protrudes downward, is provided on the lower surface in the vicinity of a connection portion between the main body portion 56 and the attachment member 130. As shown in FIG. 9A, protruding portions 88 and 89 are provided on the end portions of the protruding member 90 in the left-right direction, and the protruding portions 88 and 89 protrude further than a center portion 87 in the left-right direction in a direction opposite to the first direction (namely, in the downward direction). As shown in FIG. 9B, in the usage state, a position of the lower end of the center portion 87 is substantially the same as the inner edge 83 of the second frame 52, and positions of the lower ends of the protruding portions 88 and 89 are lower than the inner edge 83 of the second frame 52. Each of the protruding portions 88 and 89 has a rounded shape that has been chamfered. When the embroidery frame 5 moves in the left-right direction with respect to the cylinder bed 10 of the sewing machine 1, the protruding portions 88 and 89 of the protruding member 90 come into contact with the upper surface of the cylinder bed 10, and regulate the position, in the up-down direction, of the embroidery frame 5 with respect to the cylinder bed 10. The length in the left-right direction of the protruding member 90 is slightly longer than the length in the left-right direction of the main body portion 56. In the usage state, the inner edge 83 of the main body portion 56 of the second frame 52 as seen from the first direction is substantially aligned with the inner edge 73 of the main body portion 71 of the first frame 51.

The guide portion 57 is provided on an outer peripheral portion of the clamping surface 82 and guides the first frame 51 to the clamping surface 82. The guide portion 57 protrudes further than the clamping surface 82 in the first direction (the upward direction) that intersects the clamping surface 82. In the usage state, the first direction of the present embodiment is the direction on the side of the first frame 51, among the directions orthogonal to the clamping surface 82. The guide portion 57 is configured by a non-magnetic material, such as a plastic resin or the like. The guide portion 57 has a shape that is larger than the inner edge 83 of the second frame 52 as seen from the first direction (from above), and is a polygonal frame shape having a plurality of corner portions 95 to 98. The corner portions 95 to 98 are respectively provided on the front left portion, the rear left portion, the rear right portion, and the front right portion of the square-shaped guide portion 57. The guide portion 57 of the present embodiment has a square shape in a plan view, in which the shape of the inner edge 83 of the main body portion 56 has been made larger from the side of the inner edge 83 to the side of the outer edge 85 of the main body portion 56. The guide portion 57 has inclined surfaces 91 to 94 that are inclined to the side of the clamping surface 82 (in the downward direction) the further they extend in a second direction from the outer side toward the inner side of the second frame 52. Of each of the sides of the square shaped guide portion 57, the inclined surfaces 91 to 94 are respectively provided on the side of the inner edge 83 of the main body portion 56. The inclined surfaces 91 and 93 face each other and the inclined surfaces 92 and 94 face each other. For example, in the left-hand side of the guide portion 57, the second direction is the rightward direction, and the inclined surface 91 provided on the left-hand side is inclined downward in the rightward direction. Similarly, in the right-hand side of the guide portion 57, the second direction is the leftward direction, and the inclined surface 93 provided on the right-hand side is inclined downward in the leftward direction. Angles of the inclined surfaces 91 to 94 with respect to the clamping surface 82 are set to any degree between 30 degrees to 60 degrees, for example. Each of the plurality of corner portions 95 to 98 protrude in the first direction with respect to the clamping surface 82, but a protrusion amount in the first direction with respect to the clamping surface 82 is smaller than for other portions of the guide portion 57 (portions forming the four sides of the guide portion 57).

The guide portion 57 of the present embodiment includes a pair of moving members 58 and 59. The second frame 52 of the present embodiment further includes a plurality of guide members 101 to 104. The pair of moving members 58 and 59 of the present embodiment respectively form at least a part of the guide portion 57, and are fixed to the main body portion 56 such that they can move in the second direction and a third direction that is the opposite direction to the second direction. Each of the pair of moving members 58 and 59 has the same shape, and the shape (a planar shape) thereof is an L shape when seen from the first direction. As shown in FIG. 4B, a cross-sectional shape of the pair of moving members 58 and 59 in the second direction is a hook shape that is open downward. The end portions in the third direction of the pair of moving members 58 and 59 are in contact with the main body portion 56, and the end portions in the second direction of the moving members 58 and 59 are separated from the main body portion 56. The pair of moving members 58 and 59 are arranged such that the L shaped angles thereof are arranged so as to be diagonal to each other, thus forming the square frame shape of the guide portion 57. The moving member 58 includes the inclined surfaces 91 and 92 provided on the left-hand side and the rear side of the square guide portion 57, and a plurality of long holes 111 to 113 that extend in the second direction and the third direction at the corner portion 96, and can move with respect to the main body portion 56. The moving member 59 includes the inclined surfaces 93 and 94 provided on the right-hand side and the front side of the square guide portion 57, and a plurality of long holes 121 to 123 extending in the second direction and the third direction at the corner portion 98, and can move with respect to the main body portion 56. Each of the plurality of guide members 101 to 104 extends in the first direction. The guide member 101 is inserted into the long holes 111 and 121, and guides the movement of the moving members 58 and 59. The guide member 102 is inserted into the long hole 112 and guides the movement of the moving member 58. The guide member 103 is inserted into the long holes 113 and 123, and guides the movement of the moving members 58 and 59. The guide member 104 is inserted into the long hole 122, and guides the movement of the moving member 59. The guide members 101 and 103 are pins that extend in the first direction from the upper surface of the main body portion 56, and the upper ends of the guide members 101 and 103 are fixed by retaining rings. The guide member 102 is a screw that extends in the first direction, and fixes the moving member 58 to the main body portion 56. The guide member 104 is a screw that extends in the first direction, and fixes the moving member 59 to the main body portion 56. As shown in FIG. 4B, there is a gap D between an inner edge 75 of the guide portion 57 and the main body portion 56. The gap D is formed around the whole periphery of the inner edge 75 of the guide portion 57. The length of the gap D in the first direction is set while taking into account the thickness of the sewing object C that can be clamped by the embroidery frame 5.

When the first frame 51 and the second frame 52 hold the sewing object C using the magnetic force (the usage state), the clamping surface 82 of the second frame 52 faces the lower end portion 70 of the cladding portion 64 of the first frame 51. The main body portion 71 of the first frame 51 is disposed further in the second direction than the guide portion 57. In other words, the outer edge 74 of the main body portion 71 is surrounded by the guide portion 57.

The mounting portion 55 is removably mounted on the sewing machine 1. In a predetermined mounting position to be described later, the mounting portion 55 is removably mounted using the frame attachment member 31 that is provided in the sewing machine 1. The mounting portion 55 includes the attachment member 130 and a positioning member 140. The attachment member 130 is supported by the frame attachment member 31. The attachment member 130 is provided on the rear portion of the embroidery frame 5. The attachment member 130 is provided with a pair of left and right insertion portions 134, and a protrusion 137. The pair of left and right insertion portions 134 are formed by bending the end portions in the left-right direction of the attachment member 130 upward, and include holes 138 that penetrate in the left-right direction. The protrusion 137 protrudes downward in the vicinity of the center, in the left-right direction, of the rear portion of the attachment member 130. The position in the left-right direction of the protrusion 137 with respect to the attachment member 130 is set to a position that is unique to the embroidery frame 5. The positioning member 140 regulates the mounting position of the attachment member 130 with respect to the frame attachment member 31. The positioning member 140 extends in the left-right direction and is a flexible plate spring. The positioning member 140 has a pair of left and right grip portions 142. The pair of left and right grip portions 142 are provided on the left end and the right end of the positioning member 140, respectively. Each of the pair of grip portions 142 can cause the position of the positioning member 140 to move in the up-down direction, as a result of being manipulated by the user. As shown in FIG. 2, the pair of grip portions 142 are respectively inserted into the holes 138 of the attachment member 130.

As shown in FIG. 2 and FIG. 3, the frame attachment member 31 is mainly provided with an attachment portion 32 and a switching plate 33. The attachment portion 32 can be mounted on the embroidery frame 5. The attachment portion 32 is mainly provided with an attachment member 34 and a pressing member 35. The attachment member 34 is plate-shaped, and extends in the left-right direction. As well as fixing the frame attachment member 31 to the holder 25 of the sewing machine 1 shown in FIG. 2, the attachment member 34 guides the movement of the switching plate 33. The pressing member 35 is a rectangular shape that is long in the left-right direction in a plan view. When the attachment member 130 of the embroidery frame 5 is positioned in the mounting position, the pressing member 35 is disposed above the attachment member 130, and urges the attachment member 130 to the side of the attachment member 34 (downward). When the grip portions 142 are manipulated in the state in which the attachment member 130 is positioned in the mounting position, the pressing member 35 further urges the positioning member 140 in a removal direction. The removal direction is a movement direction of the attachment member 130 when the attachment member 130 is moved from the mounting position. The removal direction of the present embodiment is a direction opposite to a mounting direction, and is a direction from the rear toward the front. The pressing member 35 is fixed to the attachment member 34 by screws inserted through each of through holes.

The switching plate 33 is a moving member that moves in the rightward direction in concert with an operation to mount the attachment member 130 of the embroidery frame 5 on the attachment portion 32, and a movement amount of the switching plate 33 is set in accordance with the type of the embroidery frame 5. The switching plate 33 is urged in the leftward direction by an urging member (not shown in the drawings). The switching plate 33 is provided with an engagement portion 37 that extends upward in a hook shape from a rear left end portion of the switching plate 33. The engagement portion 37 engages with a detector 29 that is included in a rotary potentiometer (not shown in the drawings). The detector 29 rotates in accordance with a movement amount of the switching plate 33. Thus, the rotary potentiometer can detect the movement amount of the switching plate 33 on the basis of a rotation amount of the detector 29. The sewing machine 1 can detect the type of the embroidery frame 5 on the basis of the rotation amount of the detector 29 detected by the rotary potentiometer.

Figure 7A:
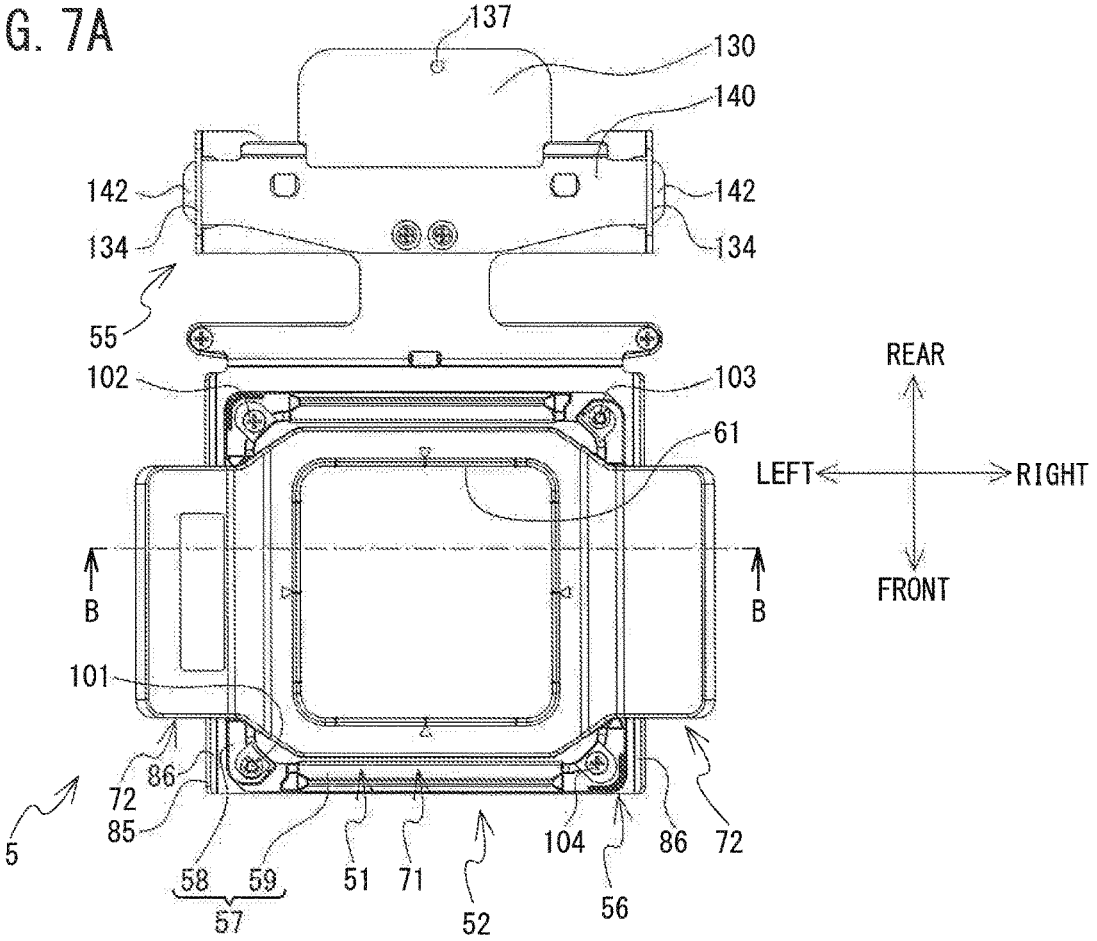
FIG. 7A is a plan view of the embroidery frame 5 when, with respect to FIG. 4A, the moving members 58 and 59 have moved from the inside to the outside of the second frame 52.
Figure 7B:
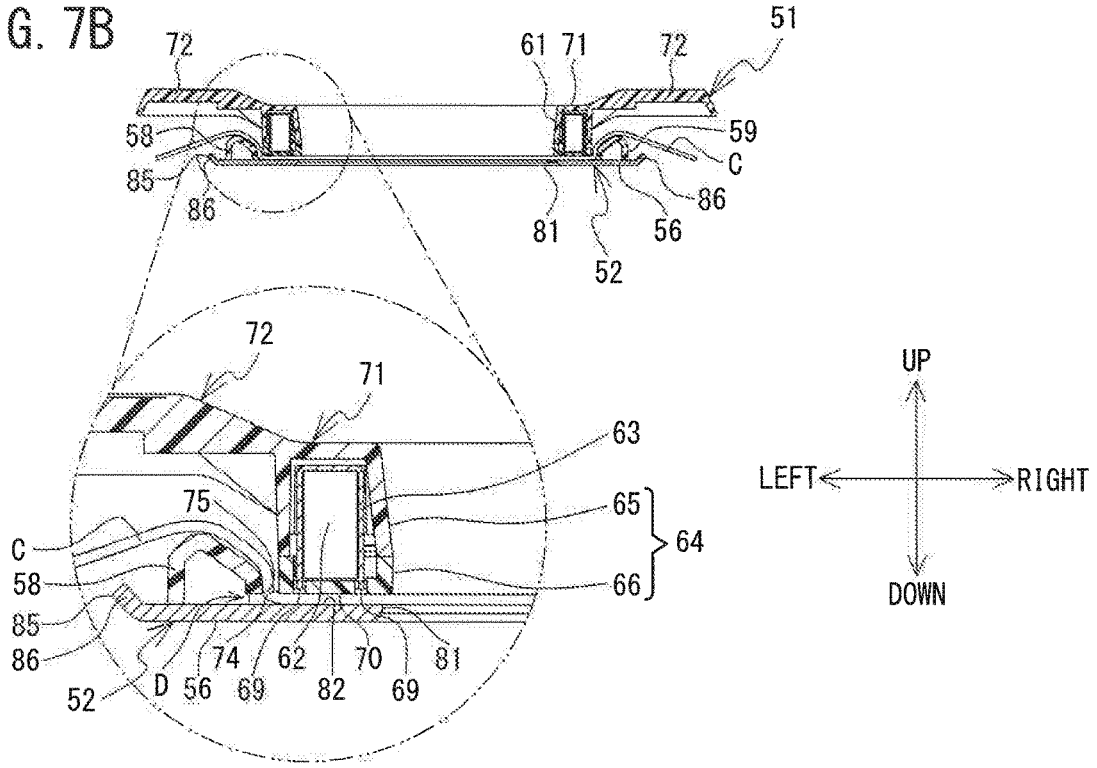
FIG. 7B is a cross-sectional view in the direction of arrows along a line B-B shown in FIG. 7A.

An operation to hold the sewing object C using the embroidery frame 5 will be explained with reference to FIG. 4, and FIG. 6 to FIG. 8. The user adjusts the positions of the moving members 58 and 59 in relation to the main body portion 56 in accordance with the thickness of the sewing object C. When the thickness of the sewing object C is relatively thin, the user moves the moving members 58 and 59 with respect to the main body portion 56 such that each of the guide members 101 to 103 are disposed at the end portions in the third direction of the long holes 111 to 113, and each of the guide members 101, 104, and 103 are disposed at the end portions in the third direction of the long holes 121 to 123. Then, the user fixes the moving members 58 and 59 with respect to the main body portion 56. In this case, as shown in FIG. 4A and FIG. 4B, a gap between the outer edge 74 of the main body portion 71 of the first frame 51 and the inner edge 75 of the guide portion 57 is relatively narrow. When the thickness of the sewing object C is relatively thick, the user moves the moving members 58 and 59 with respect to the main body portion 56 such that each of the guide members 101 to 103 are disposed at the end portions in the second direction of the long holes 111 to 113, and each of the guide members 101, 104, and 103 are disposed at the end portions in the second direction of the long holes 121 to 123. Then, the user fixes the moving members 58 and 59 with respect to the main body portion 56. In this case, as shown in FIG. 7A and FIG. 7B, the gap between the outer edge 74 of the main body portion 71 of the first frame 51 and the inner edge 75 of the guide portion 57 is wider than in the case exemplified in FIG. 4A and FIG. 4B.

Figure 8:
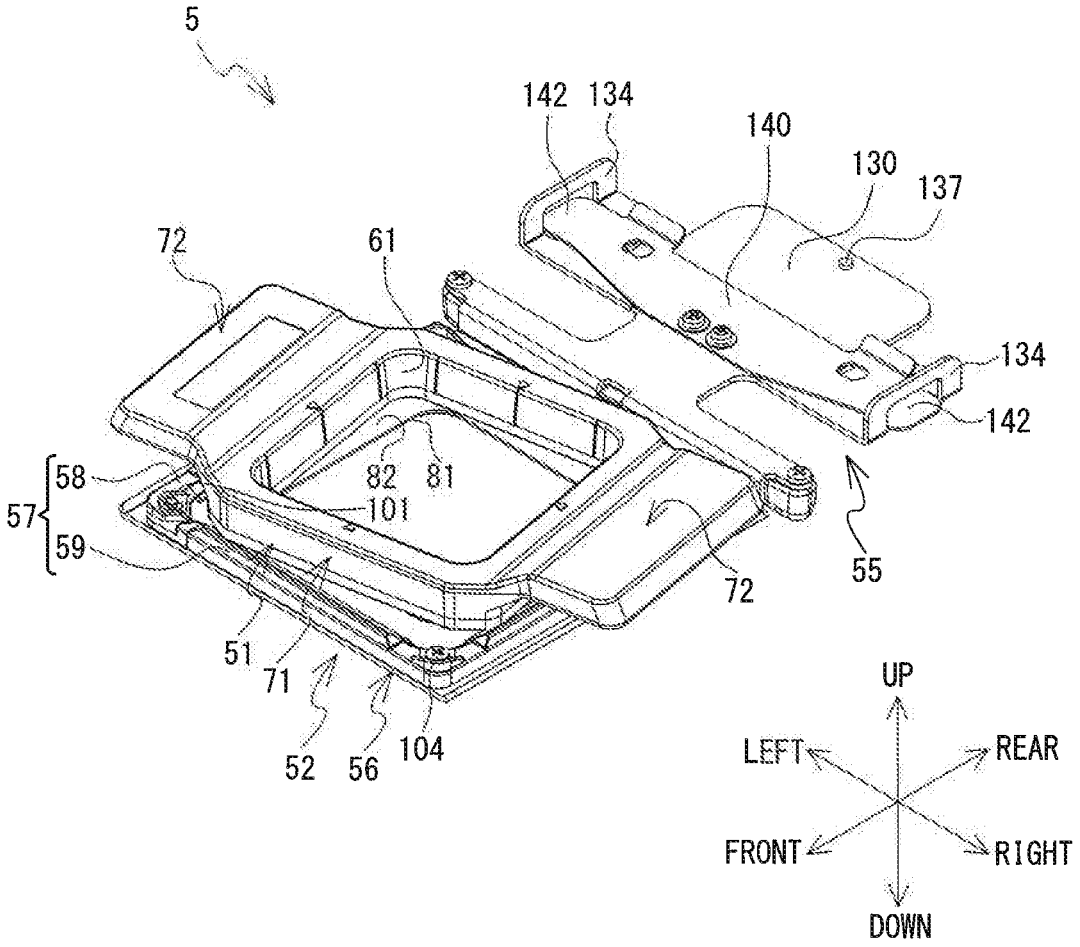
FIG. 8 is an explanatory diagram of a process to perform position alignment of the second frame 52 with respect to the first frame 51.

The user places the sewing object C on the second frame 52, and causes the first frame 51 to approach the sewing object C from the opposite side to the second frame 52. As shown in FIG. 8, when the first frame 51 approaches the second frame 52 in a state of being rotated in a plan view with respect to the second frame 52, the first frame 51 is guided by the inclined surfaces 91 to 94 of the guide portion 57. Due to the magnetic force acting between the first frame 51 and the second frame 52, the first frame 51 is attracted to the clamping surface 82 of the second frame 52 while rotating in the clockwise direction in a plan view. The first frame 51 moves to a position, with respect to the second frame 52, in which the hole 61 of the first frame 51 and the hole 81 of the second frame 52 are substantially aligned, and the sewing object C is held by the magnetic force acting between the first frame 51 and the second frame 52.

In the present embodiment, there is the gap D between the inner edge 75 of the guide portion 57 and the main body portion 56. The sewing object C is stretched horizontally over a section that becomes a sewing area set on the inside of the embroidery frame 5, and is held by the end portion 70 of the first frame 51 and the clamping surface 82. In the vicinity of the outer edge 74 of the main body portion 71 of the first frame 51 and the inner edge 75 of the guide portion 57, the sewing object C bends along the inclined surfaces 91 to 94 of the guide portion 57. At this time, the sewing object C can enter into the gap D, and, since sections of the sewing object C that follow along the inclined surfaces 91 to 94 are not pressed by the first frame 51, holding marks along the inner edge 75 of the guide portion 57 do not easily occur in the sewing object C. Further, a protrusion amount in the first direction (the upward direction) of each of the corner portions 95 to 98 of the guide portion 57 of the present embodiment is smaller than other sections of the guide portion 57. As a result, the sewing object C can enter into the corner portions 95 to 98 that are lower than the other sections, and polygonal corner-shaped holding marks do not easily occur in the sewing object C.

Operations to mount the embroidery frame 5 on the sewing machine 1 will be explained with reference to FIG. 3 and FIG. 4. By inserting a pair of thumb screws 43 into a hole (not shown in the drawings) of the attachment member 34 and a hole (not shown in the drawings) of the holder 25 and tightening the thumb screws 43, the user attaches the frame attachment member 31 to the holder 25. When the embroidery frame 5 is mounted on the frame attachment member 31 that is mounted on the sewing machine 1, the user first moves the embroidery frame 5 horizontally in the mounting direction (the rearward direction). The protrusion 137 is housed in a predetermined position while being guided by the attachment member 34. At this time, the switching plate 33 moves in the rightward direction in accordance with the position of the protrusion 137 with respect to the attachment member 34. When the user moves the embroidery frame 5 horizontally further in the mounting direction, the horizontal movement of the attachment member 130 is regulated and the position of the embroidery frame 5 in the horizontal direction is fixed. Since the attachment member 130 is pressed from above by the pressing member 35, the attachment member 130 is clamped between the pressing member 35 and the attachment member 34. The position of the attachment member 130 in the up-down direction is fixed. By the above-described operations, the embroidery frame 5 is mounted on the frame attachment member 31 of the sewing machine 1. The sewing machine 1 can detect the type of the embroidery frame 5 by detecting the movement amount of the switching plate 33, using the rotation amount of the detector 29.

When the embroidery frame 5 is removed from the frame attachment member 31 that is mounted on the sewing machine 1, the user lifts the grip portions 142 upward. When the grip portions 142 are lifted upward, the positioning member 140 deflects and receives a force from the pressing member 35 in the removal direction. The attachment member 130 becomes able to move in the horizontal direction, and, using the force from the pressing member 35 in the removal direction, the user can smoothly move the embroidery frame 5 horizontally in the removal direction. In other words, the user can easily remove the embroidery frame 5 from the mounting position.

Figure 9C:
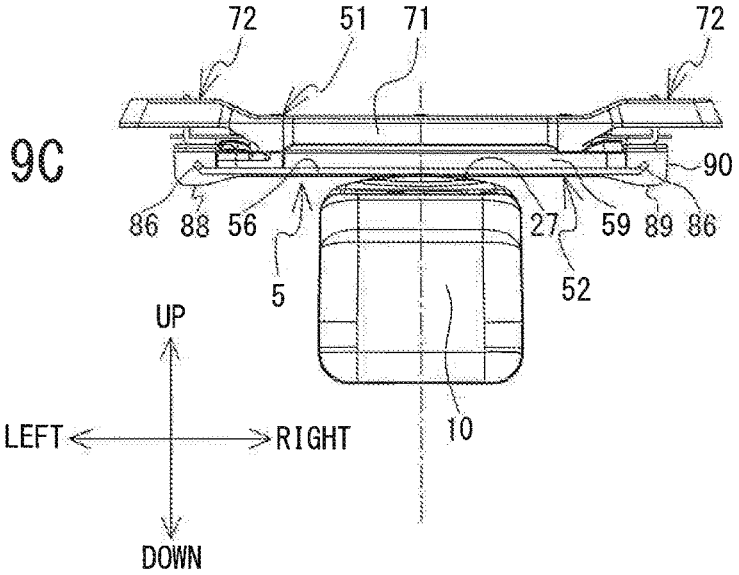
FIG. 9C is a front view when the embroidery frame 5 is disposed in a sewing position.

As shown in FIG. 9B, in the state in which the embroidery frame 5 is mounted on the sewing machine 1 via the frame attachment member 31, when the second frame 52 is arranged on the right or the left of the cylinder bed 10, due to the weight of the embroidery frame 5 itself, the position of the lower end of the embroidery frame 5 may be lower than the upper surface of the cylinder bed 10. In this type of state, if the sewing machine 1 moves the embroidery frame 5 to the sewing position, the end portion of the second frame 52 collides with the cylinder bed 10. The second frame 52 of the present embodiment is provided with the protruding member 90. As shown in FIG. 9B, the protruding portion 88 or 89 of the protruding member 90 comes into contact with the cylinder bed 10 in the course of the sewing machine 1 moving the embroidery frame 5 to the sewing position, and the embroidery frame 5 is lifted such that it is positioned above the cylinder bed 10. As a result of this, the end portion of the second frame 52 does not collide with the cylinder bed 10. In the present embodiment, the outer edge 85 in the left-right direction of the second frame 52 is provided with the inclined portions 86. Thus, as shown in FIG. 9C, even if the end portion of the second frame 52 collides with the cylinder bed 10 in the course of the sewing machine 1 moving the embroidery frame 5 to the sewing position, the movement of the embroidery frame 5 is guided by the inclined portion 86, and the embroidery frame 5 smoothly rides up over the cylinder bed 10.

Figure 10A:
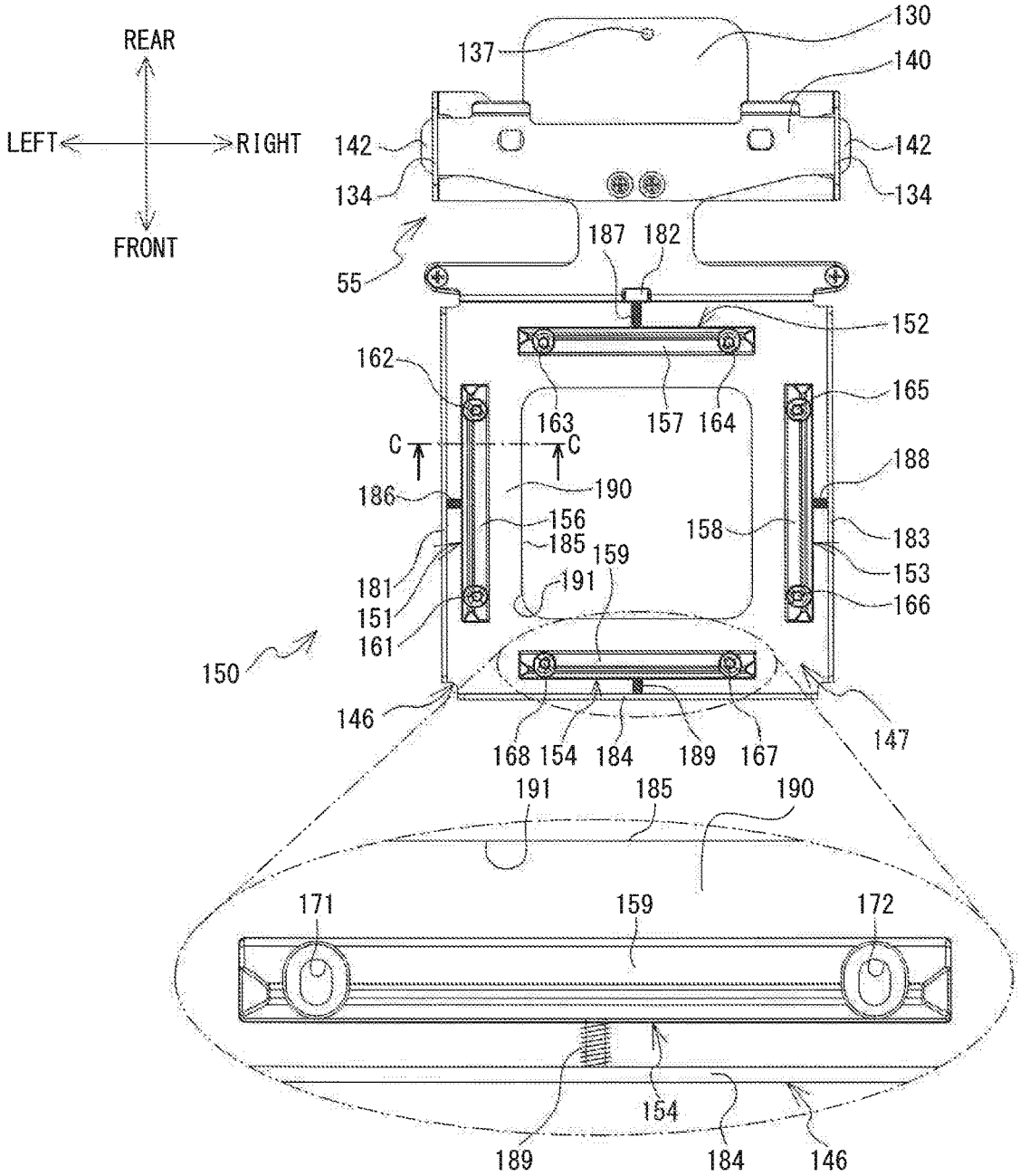
FIG. 10A is a plan view of a second frame 150 and the mounting portion 55 according to a second embodiment and an enlarged view of a moving member 154 from which guide members 167 and 168 have been removed.
Figure 10B:
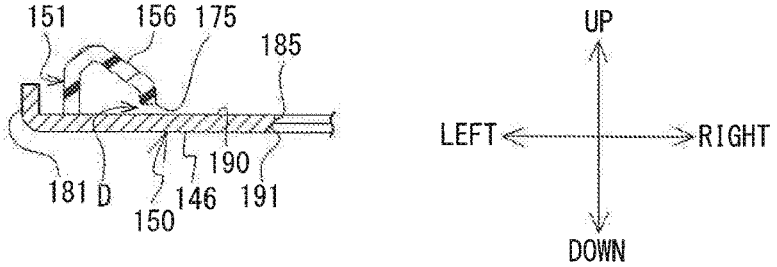
FIG. 10B is a cross-sectional view in the direction of arrows along a line C-C shown in FIG. 10A.

The embroidery frame 5 of a second embodiment will be explained. The embroidery frame 5 of the second embodiment is different from the embroidery frame 5 of the first embodiment only in the configuration of a second frame 150, and the remaining configuration is the same as that of the embroidery frame 5 of the first embodiment. Where the configuration of the second frame 150 of the second embodiment shown in FIG. 10A and FIG. 10B is the same as that of the second frame 52 of the first embodiment, the same reference numerals are assigned. As shown in FIG. 10A, the points of difference of the second frame 150 of the second embodiment with respect to the second frame 52 of the first embodiment are the configuration of a main body portion 146 and a guide portion 147, and the provision of urging members 186 to 189. An explanation of the configuration that is the same as that of the embroidery frame 5 of the first embodiment is omitted, and the configuration that is different from the embroidery frame 5 of the first embodiment will be explained.

The second frame 150 of the second embodiment as shown in FIG. 10A includes the main body portion 146, the guide portion 147, and guide members 161 to 168. Similarly to the first embodiment, the main body portion 146 is a square frame shape and includes a hole 185 and a clamping surface 190. The rear end portion of the main body portion 146 is coupled to the front end portion of the attachment member 130 of the mounting portion 55. In the present embodiment, the main body portion 146 is configured integrally with the attachment member 130 of the mounting portion 55, from a magnetic material, such as stainless steel or the like. The clamping surface 190 is provided extending horizontally around the peripheral edge of an inner edge 191 of the main body portion 146. Of the upper surface of the main body portion 146, the clamping surface 190 is further to the side of the inner edge 191 than the guide portion 147. When the sewing object C is clamped by the first frame 51 and the second frame 150, the sewing object C is placed on the clamping surface 190. The main body portion 146 is provided with attachment portions 181, 183, and 184 that are processed so as to bend in the first direction (the upward direction) at each of the left side, the right side, and the front side forming the outer edge portion of the main body portion 146. Each of the attachment portions 181, 183, and 184 is bent at a right angle with respect to the clamping surface 190. The main body portion 146 is provided with an attachment portion 182 that protrudes in the first direction (the upward direction) from the clamping surface 190, in a substantially center portion in the left-right direction of the rear portion of the main body portion 146.

The guide portion 147 is provided on an outer peripheral portion of the clamping surface 190 and guides the first frame 51 to the clamping surface 190. With respect to the clamping surface 190, the guide portion 147 protrudes further than the clamping surface 190 in the first direction (the upward direction), and has inclined surfaces 156 to 159 that are inclined to the side of the clamping surface 190 the further they extend in the second direction from the outer side toward the inner side of the second frame 150. The guide portion 147 is configured by a non-magnetic material, such as a plastic resin or the like.

The guide portion 147 is provided with moving members 151 to 154. The moving members 151 to 154 are respectively provided with the inclined surfaces 156 to 159, and have the same shape as each other. In a plan view, each of the moving members 151 to 154 is a rectangular shape, and extends along the respective side of the square inner edge 191 on the outer peripheral portion of the clamping surface 190. As exemplified by the moving member 154, a pair of long holes 171 and 172 that extend in the second direction with respect to the moving member 154 are provided at both the end portions of each of the moving members 151 to 154. The guide members 161 to 168 are pins that extend from the main body portion 146 in the first direction, and the upper ends of the guide members 161 to 168 are fixed by retaining rings. As exemplified by the guide members 168 and 167, the guide members 161 to 168 are respectively inserted into the long holes 171 and 172 of the corresponding moving members 151 to 154, and guide the movement of the moving members 151 to 154 with respect to the main body portion 146.

First end portions of the urging members 186 to 189 are respectively fixed to surfaces that form the end portions in the third direction of each of the moving members 151 to 154. Of the surfaces forming the end portions in the third direction, the first end portions of the urging members 186 to 189 are respectively fixed in a substantially center portion in the lengthwise direction of the moving members 151 to 154. Second end portions of the urging members 186 to 189 are respectively fixed to attachment portions 181 to 184. The moving members 151 to 154 are respectively urged in the second direction by the urging members 186 to 189. The urging members 186 to 189 are coil springs, for example. As shown in FIG. 10B, for example, the moving member 151 that is provided in parallel to the left side of the inner edge 191 of the second frame 150 is provided with the inclined surface 156 that is inclined downward in the rightward direction that is the second direction. The first end of the urging member 186 is fixed to the center portion in the front-rear direction of the left side surface of the moving member 151, and the moving member 151 is urged in the rightward direction by the urging member 186. There is the gap D between an inner edge 175 of the moving member 151 and the main body portion 146.

In the embroidery frame 5 of the second embodiment, the position of the moving members 151 to 154 with respect to the main body portion 146 is automatically adjusted in accordance with the thickness of the sewing object C, using the effect of the urging members 186 to 189. Thus, when the sewing object C is held, the user does not need to adjust, in advance, the position of the moving members 151 to 154 with respect to the main body portion 146 in accordance with the thickness of the sewing object C. When the thickness of the sewing object C is relatively thin, the guide members 161 to 168 are disposed in the end portions in the third direction of the long holes 171 or the long holes 172. When the thickness of the sewing object C is relatively thick, the moving members 151 to 154 move with respect to the main body portion 146 in resistance to an urging force of the urging members 186 to 189, such that the guide members 161 to 168 are disposed in the end portions in the second direction of the long holes 171 or the long holes 172.

Effects common to the embroidery frame 5 of the first embodiment and of the second embodiment will be explained taking the embroidery frame 5 of the first embodiment as an example. In the embroidery frame 5, when the sewing object C is clamped by the first frame 51 and the second frame 52, the first frame 51 is guided by the guide portion 57, and moves smoothly to the side of the clamping surface 82 of the second frame 52 on which the sewing object C is placed. At this time, since the guide portion 57 is configured by the non-magnetic material, there is no attraction between the guide portion 57 and the magnets 62 of the first frame 51. Thus, in the embroidery frame 5, due to the magnetic force acting between the first frame 51 and the second frame 52, the operation to cause the sewing object C to be held appropriately between the first frame 51 and the second frame 52 is easier than in the embroidery frame of related art. Since the embroidery frame 5 of the present embodiment is provided with the pair of gripping portions 72 on the first frame 51, the operations to mount the second frame 52 on the first frame 51 and remove the second frame 52 from the first frame 51 are easier than with the embroidery frame that does not have the holding portions.

The guide portion 57 is a frame shape whose shape is larger than the inner edge 83 of the second frame 52 when seen from the first direction. A protrusion amount in the first direction with respect to the clamping surface 82 of a section of the guide portion 57 in a peripheral direction, which is a direction along the inner edge 83 of the second frame 52, is smaller than other sections of the guide portion 57. When the sewing object C is sewn while being held by the first frame 51 and the second frame 52, there is a case in which the sewing object C is folded over and there is sometimes a section at which the thickness of the sewing object C between the first frame 51 and the second frame 52 becomes thicker than at other sections. In this type of case also, the embroidery frame 5 can alleviate an impact with the thickness of the sewing object C has increased, using the part of the guide portion 57.

Each of the inner edges 73 and 83 of the first frame 51 and the second frame 52 of the embroidery frame 5 is the polygonal shape. When the inner edge of each of the first frame and the second frame is the polygonal shape, when the sewing object is held by the first frame and the second frame, the sewing object is folded over at corner portions thereof and wrinkles easily occur. In contrast to this, the shape of the guide portion 57 of the present embodiment is larger than the inner edge 83 of the second frame 52 when seen from the first direction, and is the polygonal frame shape including the plurality of corner portions 95 to 98. The protrusion amount of each of the plurality of corner portions 95 to 98 in the first direction is smaller with respect to the clamping surface 82 than the other portions of the guide portion 57. The embroidery frame 5 can suppress the occurrence of wrinkles when the sewing object C clamped between the first frame 51 and the second frame 52 is folded over at the corner portions 95 to 98 of the guide portion 57.

The guide portion 57 is provided with the moving members 58 and 59 that form at least a part of the guide portion 57, that can move in the second direction and the third direction that is the opposite direction to the second direction, and that are fixed to the main body portion 56. When the thickness of the sewing object C is relatively thin, the embroidery frame 5 moves the position of at least a part of the guide portion 57 with respect to the main body portion 56 in the second direction, and when the thickness of the sewing object C is relatively thick, the embroidery frame 5 moves the position of at least a part of the guide portion 57 with respect to the main body portion 56 in the third direction that is on the opposite side to the second direction, and thus, the embroidery frame 5 can appropriately clamp both the sewing objects C. The cross-sectional shape of the moving members 58 and 59 in the second direction is the hook shape that is open downward. Thus, the embroidery frame 5 can cause the weight of the moving members 58 and 59 to be relatively light.

The guide portion 57 is provided with the moving members 58 and 59, and the second frame 52 is further provided with the guide members 101 to 104. The moving member 58 includes the inclined surfaces 91 and 92 and the plurality of long holes 111 to 113 that extend in the second direction and the third direction at the corner portion 96, and can move with respect to the main body portion 56. The moving member 59 includes the inclined surfaces 93 and 94 and the plurality of long holes 121 to 123 that extend in the second direction and the third direction at the corner portion 98, and can move with respect to the main body portion 56. The guide members 101 to 104 extend in the first direction and guide the movement of the moving members 58 and 59. By changing the positions of the moving members 58 and 59 with respect to the main body portion 56, the embroidery frame 5 can change a space between the inner edge 74 of the main body portion 71 of the first frame 51 and the inner edge 75 of the guide portion 57. When the thickness of the sewing object C is relatively thin, the user moves the moving member 58 such that the guide members 101 to 103 are positioned on the side of the end portions in the third direction of the long holes 111 to 113, and moves the moving member 59 such that the guide members 101, 104, and 103 are positioned on the side of the end portions in the third direction of the long holes 121 to 123. When the thickness of the sewing object C is relatively thick, the user moves the moving member 58 such that the guide members 101 to 103 are positioned on the side of the end portions in the second direction of the long holes 111 to 113, and moves the moving member 59 such that the guide members 101, 104, and 103 are positioned on the side of the end portions in the second direction of the long holes 121 to 123. By changing the positions of the moving members 58 and 59 with respect to the main body portion 56 in this way, the embroidery frame 5 can appropriately clamp each of the sewing objects C having the different thicknesses. The embroidery frame 5 can simplify the configuration of the guide portion 57.

In the embroidery frame 5, there is the gap D between the inner edge 75 of the guide portion 57 and the main body portion 56. In the embroidery frame 5, the sewing object C can enter into the gap D between the inner edge 75 of the guide portion 57 and the main body portion 56. Thus, the embroidery frame 5 can suppress the formation of wrinkles in the sewing object C clamped between the first frame 51 and the second frame 52.

The main body portion 56 is provided with the inclined portions 86 that incline in the first direction from the inner side toward the outer side of the second frame 52, on the peripheral edge of the outer edge 85. Even if the second frame 52 makes contact with the cylinder bed 10 of the sewing machine 1 as a result of the embroidery frame 5 being moved in the state in which the embroidery frame 5 is mounted on the sewing machine 1, the embroidery frame 5 can smoothly move while being guided by the inclined portions 86. It is thus possible to avoid failure resulting from the collision of the second frame 52 with the cylinder bed 10.

The embroidery frame 5 is provided with the rounded protruding portions 88 and 89, which are the portions protruding further in the direction opposite to the first direction (in the downward direction) than the inner edge 83 of the second frame 52, on a portion that is further in the third direction than the inner edge 83 of the second frame 52. Thus, as shown in FIG. 9B, in the course of the sewing machine 1 moving the embroidery frame 5 to the sewing position after the embroidery frame 5 has moved to a position other than the position above the cylinder bed 10, the protruding portion 88 or 89 of the protruding member 90 comes into contact with the cylinder bed 10, and the movement of the embroidery frame 5 with respect to the cylinder bed 10 is smoothly guided. In this way, the second frame 52 of the embroidery frame 5 is lifted so as to be positioned above the cylinder bed 10, and it is possible to avoid the end portion of the second frame 52 colliding with the cylinder bed 10. When the embroidery frame 5 has moved to the sewing position, the center portion 87 of the protruding member 90 is disposed above the cylinder bed 10, a distance between the lower surface of the second frame 52 and the cylinder bed 10 (the needle plate 27) is a distance suitable for the sewing, and the protruding member 90 does not obstruct the sewing.

The first frame 51 is provided with the yokes 63 and the cladding portion 64. The yokes 63 conduct the magnetic flux caused by the magnets 62. The cladding 64 is configured by the non-magnetic material that holds the magnets 62 and the yokes 63. The embroidery frame 5 can increase the magnetic force of the magnets 62 using the yokes 63. The embroidery frame 5 can clamp the sewing object C using a stronger magnetic force than the embroidery frame 5 that does not have the yokes 63.

The end portions of the yokes 63 facing the second frame 52 are exposed to the outside from the cladding 64 (to the side of the second frame 52), and do not protrude further to the side of the second frame 52 than the end portion of the cladding 64 on the side facing the main body portion 56. The embroidery frame 5 can reduce a possibility of damaging the sewing object C as a result of the yokes 63 coming into contact with the sewing object C while causing the yokes 63 of the first frame 51 to be as close as possible to the non-magnetic material side of the second frame 52. The magnets 62 are relatively susceptible to being damaged by impact. In the embroidery frame 5 of the present embodiment, since the magnets 62 are not exposed to the outside from the cladding 64, the possibility can be reduced of the magnets 62 coming into contact with an object on the outside and being damaged.

Unique effects of the embroidery frame 5 of the second embodiment will be explained. The second frame 150 of the embroidery frame 5 of the second embodiment is provided with the urging members 186 to 189 that urge the moving members 151 to 154 in the second direction. Since the embroidery frame 5 of the second embodiment is provided with the urging members 186 to 189, the operation to change the position of the guide portion 147 with respect to the main body portion 146 in accordance with the thickness of the sewing object C is easy. The guide portion 147 of the second embodiment is different to the guide portion 57 of the first embodiment in that, of the outer edge 74 of the first frame 51, there are no portions corresponding to the corner portions of the main body portion 71 that is square in a plan view. Thus, in the vicinity of the corner portions, the sewing object C can be disposed along the main body portion 146. As a result, the embroidery frame 5 can reduce the possibility of the occurrence of wrinkles in the sewing object C in the vicinity of the corner portions.

The embroidery frame of the present disclosure is not limited to the above-described embodiments and various changes may be added insofar as they do not depart from the gist and scope of the present disclosure. For example, the following modifications may be added as appropriate. The configuration of the embroidery frame 5, the embroidery frame unit 30, and the sewing machine 1 may be changed as appropriate. It is sufficient that the number of the needle bars provided in the sewing machine 1 be one or more. It is sufficient that one or more types of the embroidery frame be mountable on the sewing machine 1. The embroidery frame 5 may be configured to be directly mounted on the holder 25 of the sewing machine 1. When the embroidery frame 5 is attached to the sewing machine 1 via the frame attachment member 31, the configuration of the frame attachment member 31 may be changed as appropriate. It is sufficient that the mounting portion for mounting the embroidery frame on the sewing machine be coupled to at least one of the first frame and the second frame. The protruding portions need not necessarily be provided. The number, the shape and the arrangement of the protruding portions may be changed as appropriate. It is sufficient that the protruding portions be provided on the lower surface of at least one of the second frame and the mounting portion. An attachment orientation of the embroidery frame with respect to the sewing machine may be changed as appropriate.

The size, the plan view shape, the thickness and the like of the embroidery frame 5 may be changed as appropriate. The inner edge of each of the first frame and the second frame may have a shape other than the polygonal shape, such as a circular shape, an elliptical shape, or the like. When the inner edge of each of the first frame and the second frame is the polygonal shape, the shape may be a shape other than the square shape, such as a triangular shape, a rectangular shape, a pentagonal shape, or the like. For example, an embroidery frame 250 as shown in FIGS. 11A and 11B may be adopted.

Figure 11A:
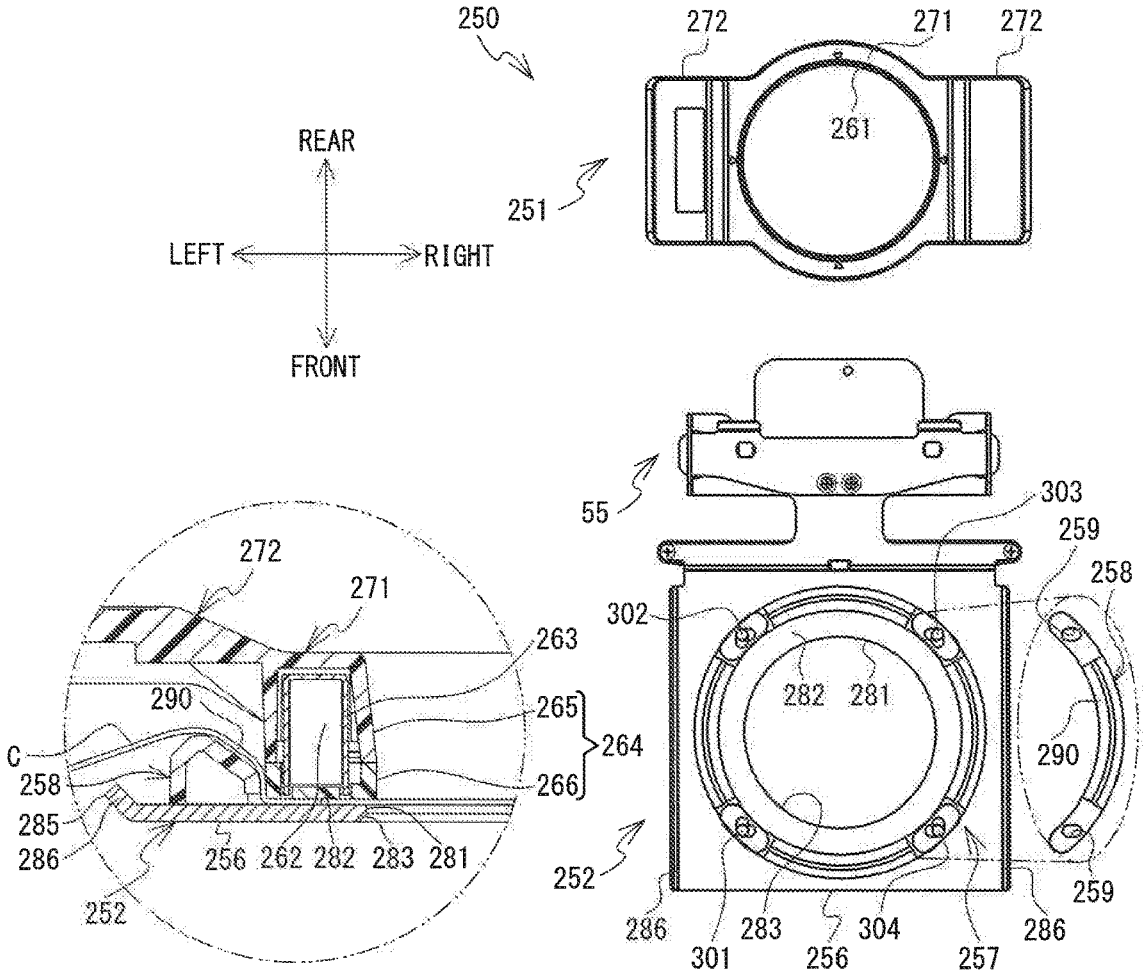
FIG. 11A is a plan view and an enlarged cross-sectional view of a first frame 251, a second frame 252, and the mounting portion 55 of an embroidery frame 250 of a modified example.
Figure 11B:
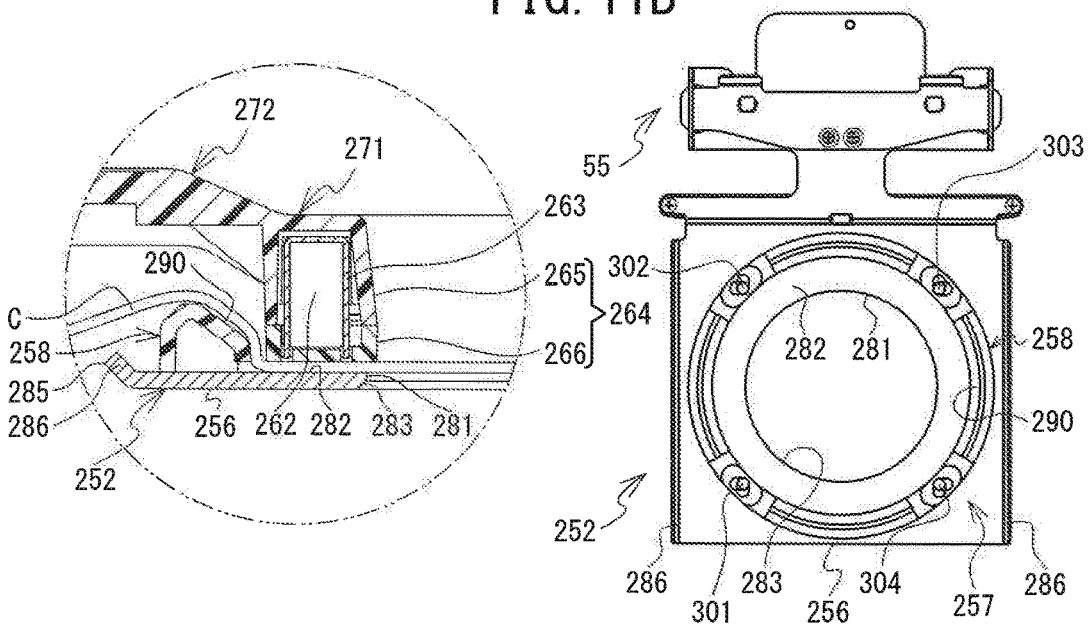
FIG. 11B is a plan view and an enlarged cross-sectional view of the second frame 252 in which, with respect to FIG. 11A, a moving member 258 has moved from the inside to the outside of the second frame 252.

The embroidery frame 250 of a modified example shown in FIGS. 11A and 11B is provided with a first frame 251, a second frame 252, and the mounting portion 55 that is the same as that of the first embodiment. The first frame 251 is provided with a main body portion 271 and a pair of holding portions 272. The main body portion 271 is a circular frame shape in a plan view, and has a hole 261 that penetrates in the up-down direction. The pair of holding portions 272 are respectively coupled to the end portions, in the left-right direction, of the main body portion 271. A view shown inside a circular virtual line in FIG. 11A is an enlarged view of a cross section of the embroidery frame 250 of the modified example, and is a view corresponding to the enlarged view in FIG. 4B. As in the view shown inside the circular virtual line in FIG. 11A, the main body portion 271 of the first frame 251 is provided with magnets 262, yokes 263, and a cladding portion 264. The cladding portion 264 is provided with a first portion 265, and a second portion 266, and the first portion 265 and the second portion 266 hold the magnets 262 and the yokes 263. Similarly to the first frame 51 of the first embodiment, the magnets 262 and the yokes 263 are arranged in the peripheral direction along the inner edge of the first frame 251.

The second frame 252 can clamp the sewing object C, together with the first frame 251, using magnetic force, and includes a main body portion 256, a guide portion 257, and guide members 301 to 304. The main body portion 256 is a circular frame shape and has a hole 281 that penetrates in the up-down direction. The main body portion 256 has a clamping surface 282 that is configured by a magnetic material, in a position facing the magnets 262 of the first frame 251, on a peripheral edge portion of an inner edge 283. The main body portion 256 includes a pair of inclined portions 286, provided on the peripheral edges of the outer edge of the main body portion 256 in the left-right direction. The guide portion 257 is configured by four moving members 258 having inclined surfaces 290. Each of the moving members 258 has the same circular arc shape, and includes a pair of long holes 259 at the end portions thereof. The pair of long holes 259 extend in the second direction and the third direction from the center of the moving member 258 in the radial direction. A protrusion amount of a portion of each of the moving members 258 that overlaps with another of the moving members 258 is smaller in the first direction (the upward direction) than other portions of each of the moving members 258. Each of the moving members 258 may be configured such that the protrusion amount in the first direction of the portions other than the portion that overlaps with the other moving member 258 is smaller than other portions. The guide members 301 to 304 are pins that extend in the first direction from the main body portion 256, and are inserted into the long holes 259 of the moving members 258.

As shown in FIG. 11A, when the thickness of the sewing object C is relatively thin, the user respectively disposes the guide portions 301 to 304 in the end portions in the third direction of the long holes 259, and fixes each of the moving members 258 with respect to the main body portion 256. As shown in FIG. 11B, when the thickness of the sewing object C is relatively thick, the user respectively disposes the guide portions 301 to 304 in the end portions in the second direction of the long holes 259, and fixes each of the moving members 258 with respect to the main body portion 256. In the embroidery frame 250, when the moving members 258 are caused to correspond to a position when the thickness of the sewing object C is relatively thick, the inner edge of the guide portion 257 is designed to be a circular shape.

In the embroidery frame 250, since the plurality of moving members 258 have the circular arc shape, when the positions are adjusted in accordance with the thickness of the sewing object C, the shape of the end portion in the second direction of the guide portion 257 is not circular, depending on the position of each of the moving members 258. It is thus preferable for at least a part of each of the moving members 258 to be configured by a flexible material, such as plastic, that can deform along the outer edge of the first frame 251. For example, when the design is adopted such that the shape of the inner edge of the guide portion is circular when holding the thin sewing object C, it is preferable that, of each of the plurality of moving members made of the flexible material, at least portions further to the end portion side than the long holes of each of the moving members be configured by the plastic flexible material.

The configuration of the first frame 51 may be changed as appropriate. A configuration of the shape, size, arrangement and number of the magnets 62, the yokes 63, the cladding portion 64, the gripping portions 72, and the like provided in the first frame 51 of the embroidery frame 5 may be changed as appropriate. It is sufficient that there be one or more of the magnets. The yokes 63 need not necessarily be provided. When the embroidery frame 5 is provided with the yokes 63, the end portions 69 of the yokes 63 need not necessarily be exposed to the outside from the cladding portion 64. The end portions 69 of the yokes 63 may be positioned lower than the lower end of the cladding portion 64. The cross-sectional shape of the yokes 63 need not necessarily be the inverted U shape.

The configuration of the second frame 52 may be changed as appropriate. The configuration of the mounting portion 55 may be changed in accordance with the configuration of the sewing machine 1. It is sufficient that the main body portion 56 be configured by the magnetic material at sections facing the magnets 62 of the first frame 51, and the whole of the main body portion 56 need not necessarily be configured by the magnetic material. For example, of the main body portion 56, only the clamping surface 82 may be configured by the magnetic material, and, of the clamping surface 82, only the sections facing the magnets 62 may be configured by the magnetic material. The magnetic material may be a pole of a magnet having the opposite polarity to the end portions 69 of the yokes 63. The guide portion 57 may be incapable of moving with respect to the main body portion 56. The guide portion 57 may be configured from single member, such as a circular frame shape or the like. A part of the guide portion 57 may be the moving member. More specifically, when the guide portion 57 includes the moving members 58 and 59, only the moving member 58 may be movable with respect to the main body portion 56, and the moving member 59 may be incapable of moving. The cross-sectional shape in the second direction of the pair of moving members 58 and 59 need not necessarily be the hook shape that is open downward. The guide portion may be the frame shape that is configured by the single member having inclined surfaces.

The shape and the like of the guide portion 57 may be changed as appropriate. The inner edge of the guide portion of the second frame need not necessarily correlate to the shape of the inner edge of the main body portion of the second frame. When the shape expressed by the end portion in the second direction of the guide portion is the polygonal shape, the protrusion amount in the first direction of the corner portions of at least a part of the guide portion need not necessarily be smaller than that of other portions of the guide portion. There need not necessarily be the gap D between the end portion of the guide portion in the second direction and the main body portion. There may be a gap between only a part of the end portion of the guide portion in the second direction and the main body portion, and not around the whole periphery of the inner edge of the guide portion. The whole periphery of the end portion, in the second direction, of the lower portion of the guide portion may be bent in the third direction. The main body portion need not necessarily be provided with the inclined portions. When the sewing machine 1 can dispose the whole of the embroidery frame 5 in front of the cylinder bed 10, the inclined portions may be provided on the rear side of the main body portion. When the guide portion is provided with the moving members, the moving members may or may not be urged in the second direction by the urging members. When the guide portion is provided with the plurality of moving members, some of the moving members may be urged in the second direction by the urging members. The urging member may be a member other than the coil spring, such as a plate spring, rubber, or the like. At least one of the moving members 58 and 59 that have the L shape in a plan view, and the moving members 258 that have the circular arc shape in a plan view may be urged in the second direction by the urging members.

What is claimed is:

1. An embroidery frame comprising:

a mounting portion configured to be removably mounted on a sewing machine;

a first frame provided with a magnet; and a second frame configured to clamp a sewing object, with the first frame, using magnetic force, the second frame including a main body portion and a guide portion, the main body portion including a clamping surface configured by a magnetic material, in a position facing the magnet of the first frame, the guide portion being provided on an outer peripheral portion of the clamping surface and guiding the first frame to the clamping surface, the guide portion being configured by a non-magnetic material, the guide portion including an inclined surface, the guide portion protruding further than the clamping surface in a first direction with respect to the clamping surface, the first direction being, of directions that intersect the clamping surface, a direction to the side of the first frame with respect to the clamping surface, and the inclined surface being inclined in a direction opposite to the first direction the further the inclined surface extends in a second direction, the second direction being a direction orthogonal to the first direction and being a direction from an outer side toward an inner side of the second frame.

2. The embroidery frame according to claim 1, wherein the guide portion is a frame shape whose shape is larger than an inner edge of the second frame when seen from the first direction, and in a peripheral direction that is a direction along the inner edge of the second frame, a protrusion amount in the first direction of a part of the guide portion with respect to the clamping surface is smaller than other parts of the guide portion.

3. The embroidery frame according to claim 2, wherein an inner edge of the first frame and the inner edge of the second frame have a polygonal shape, and the guide portion has a polygonal frame shape whose shape is larger than the inner edge of the second frame when seen from the first direction, and includes a plurality of corner portions, a protrusion amount in the first direction of the plurality of corner portions with respect to the clamping surface being smaller than other parts of the guide portion.

4. The embroidery frame according to claim 1, wherein the guide portion includes a moving member, the moving member forming at least a part of the guide portion, being movable in the second direction and a third direction, and being fixed to the main body portion, and the third direction being an opposite direction to the second direction.

5. The embroidery frame according to claim 4, wherein the moving member includes a plurality of long holes, the plurality of long holes extending in the second direction and the third direction in predetermined sections of the moving member, and the second frame is provided with a plurality of guide members, the plurality of guide members extending in the first direction, being respectively inserted into the plurality of long holes, and guiding a movement of the moving member.

6. The embroidery frame according to claim 5, wherein the guide portion is configured by a pair of the moving members whose shape is an L shape when seen from the first direction, and at least one of the pair of moving members includes the plurality of long holes.

7. The embroidery frame according to claim 5, wherein the second frame is provided with an urging member that urges the moving member in the second direction.

8. The embroidery frame according to claim 1, wherein a gap exists between an end portion of the guide portion on the second direction side and the main body portion.

9. The embroidery frame according to claim 1, wherein the main body portion is provided with an inclined portion, on a peripheral edge of an outer edge, that is inclined in the first direction from the inner side to the outer side of the second frame.

10. The embroidery frame according to claim 1, wherein a protruding portion is provided on a portion further in the third direction than an inner edge of the second frame, the protruding portion being rounded and protruding further in the opposite direction to the first direction than the inner edge of the second frame.

11. The embroidery frame according to claim 1, wherein the first frame includes a yoke and a cladding portion, the yoke conducts a magnetic flux caused by the magnet, and the cladding portion is configured by a non-magnetic material and holds the magnet and the yoke.

12. The embroidery frame according to claim 11, wherein an end portion of the yoke on a side facing the second frame is exposed from the cladding portion, and does not protrude further to the side of the second frame than an end portion of the cladding portion on a side facing the main body portion.

* * * * *